US012037726B2

(12) United States Patent
Santos et al.

(10) Patent No.: US 12,037,726 B2
(45) Date of Patent: Jul. 16, 2024

(54) BRAIDED ARTICLE AND METHOD OF MAKING

(71) Applicant: Under Armour, Inc., Baltimore, MD (US)

(72) Inventors: Craig Santos, Portland, OR (US); John Acevedo, Portland, OR (US); Thomas White, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 117 days.

(21) Appl. No.: 17/677,076

(22) Filed: Feb. 22, 2022

(65) Prior Publication Data

US 2022/0175076 A1 Jun. 9, 2022

Related U.S. Application Data

(63) Continuation of application No. 16/700,438, filed on Dec. 2, 2019, now Pat. No. 11,284,663, which is a (Continued)

(51) Int. Cl.
*D04C 3/48* (2006.01)
*A43B 1/04* (2022.01)
(Continued)

(52) U.S. Cl.
CPC ..... *D04C 3/48* (2013.01); *A43B 1/04* (2013.01); *A43B 13/127* (2013.01);
(Continued)

(58) Field of Classification Search
CPC .... D04C 1/06; D04C 3/48; A43B 1/04; A43B 13/127; A43B 23/042; A43D 3/02
See application file for complete search history.

(56) References Cited

U.S. PATENT DOCUMENTS 376,372 A 1/1888 Dodge et al.
4,519,290 A 5/1985 Inman et al.
(Continued)

FOREIGN PATENT DOCUMENTS

CN 105747351 A 7/2016
WO 2019/013982 A1 1/2019

OTHER PUBLICATIONS

International Search Report and Written Opinion issued Sep. 19, 2018 for International Application No. PCT/US2018/39900.
(Continued)

*Primary Examiner* — Shaun R Hurley
(74) *Attorney, Agent, or Firm* — Maginot, Moore & Beck, LLP

(57) ABSTRACT

In one embodiment, an article of footwear includes a first braided layer and a second braided layer. The first braided layer passes along an upper surface of a midsole while the second braided layer passes along a lower surface of the midsole. In another embodiment, an article of footwear includes a first braided layer and a second braided layer. The first braided layer passes along an upper surface of a plate while the second braided layer passes along a lower surface of the plate. The plate includes a plurality of apertures. The plurality of apertures are configured to receive ground engaging members. In another embodiment, an article of footwear includes a unitary braided component that includes a first layer and a second layer.

21 Claims, 38 Drawing Sheets

Related U.S. Application Data continuation of application No. 15/648,832, filed on Jul. 13, 2017, now Pat. No. 10,716,354.

(51) Int. Cl.

| | |
|---|---|
| ***A43B 13/12*** | (2006.01) |
| ***A43B 23/02*** | (2006.01) |
| ***A43B 23/04*** | (2006.01) |
| ***A43B 23/07*** | (2006.01) |
| ***A43D 3/02*** | (2006.01) |
| ***D04C 1/06*** | (2006.01) |
| ***D04C 3/08*** | (2006.01) |
| ***D04C 3/22*** | (2006.01) |
| *A43B 13/04* | (2006.01) |

(52) U.S. Cl.

CPC ..... *A43B 23/0215* (2013.01); *A43B 23/0235* (2013.01); *A43B 23/0255* (2013.01); *A43B 23/026* (2013.01); *A43B 23/042* (2013.01); *A43B 23/07* (2013.01); *A43D 3/02* (2013.01); *D04C 1/06* (2013.01); *D04C 3/08* (2013.01); *D04C 3/22* (2013.01); *A43B 13/04* (2013.01); *D10B 2501/043* (2013.01)

(56) References Cited

U.S. PATENT DOCUMENTS

| | | | |
|---|---|---|---|
| 4,857,124 | A | 8/1989 | Shobert et al. |
| 4,992,313 | A | 2/1991 | Shobert et al. |
| 5,203,249 | A | 4/1993 | Adams et al. |
| 5,257,571 | A | 11/1993 | Richardson |
| 5,361,674 | A | 11/1994 | Akiyama et al. |
| 5,388,497 | A | 2/1995 | Akiyama et al. |
| 5,398,586 | A | 3/1995 | Akiyama et al. |
| 5,476,027 | A | 12/1995 | Uchida et al. |
| 6,024,005 | A | 2/2000 | Uozumi |
| 7,908,956 | B2 | 3/2011 | Dow et al. |
| 8,061,253 | B2 | 11/2011 | Wybrow |
| 8,757,038 | B2 | 6/2014 | Siegismund |
| 9,668,544 | B2 | 6/2017 | Bruce et al. |
| 9,839,253 | B2 | 12/2017 | Bruce et al. |
| 9,877,536 | B2 | 1/2018 | Huffman et al. |
| 10,238,176 | B2 | 3/2019 | Bruce et al. |
| 11,090,880 | B2 | 8/2021 | Amat |
| 2005/0283962 | A1* | 12/2005 | Boudjemline ..... D04C 1/06 29/433 |
| 2006/0010931 | A1 | 1/2006 | Lynch et al. |
| 2006/0048413 | A1 | 3/2006 | Sokolowski et al. |
| 2011/0252664 | A1 | 10/2011 | Jennings |
| 2012/0066931 | A1* | 3/2012 | Dojan ..... A43B 23/0225 36/83 |
| 2012/0179272 | A1* | 7/2012 | Dignam ..... D04C 1/02 87/8 |
| 2013/0305465 | A1 | 11/2013 | Siegismund |
| 2014/0373389 | A1 | 12/2014 | Bruce |
| 2015/0007451 | A1 | 1/2015 | Bruce |
| 2015/0201707 | A1 | 7/2015 | Bruce |
| 2016/0076178 | A1 | 3/2016 | Head et al. |
| 2016/0166000 | A1 | 6/2016 | Bruce et al. |
| 2016/0166007 | A1 | 6/2016 | Bruce et al. |
| 2016/0166010 | A1 | 6/2016 | Bruce et al. |
| 2018/0319100 | A1 | 11/2018 | Amat |
| 2018/0343961 | A1* | 12/2018 | Bruce ..... A43B 23/042 |
| 2019/0098955 | A1* | 4/2019 | Bruce ..... A43B 23/04 |

OTHER PUBLICATIONS

International Preliminary Examination Report mailed Jan. 23, 2020 for International Application No. PCT/US2018/039900.

Office Action mailed Jan. 29, 2021 for Chinese Patent Application No. 2018800453205.

Notice of decision to grant patent dated Jul. 20, 2021 for Chinese Patent Application No. 2018800453205.

* cited by examiner

BRAIDED ARTICLE AND METHOD OF MAKING

CROSS-REFERENCE TO RELATED APPLICATIONS

This application is a continuation of co-pending U.S. patent application Ser. No. 16/700,438 filed on Dec. 2, 2019 and titled "Braided Article and Method of Making", which application is a continuation of U.S. patent application Ser. No. 15/648,832 filed on Jul. 13, 2017 and titled "Braided Article and Method of Making", the disclosures of which applications are hereby incorporated by reference in their entirety.

BACKGROUND

The present embodiments relate generally to articles of footwear, and in particular to articles of footwear that incorporate braided components.

Typical athletic shoes include two major components, an upper that provides the enclosure for receiving the foot, and a sole secured to the upper. The upper may include laces, hook-and-loop fasteners or other devices to provide adjustable securement of the article to the foot of a user. Some articles of footwear may incorporate midsole components to provide comfort and support to the foot of a user. Articles of footwear may also include ground-engaging members to provide traction and grip.

SUMMARY

In one embodiment, an article of footwear includes a footbed component and an interior braided layer. An outer surface of the interior braided layer is attached to an upper surface of the footbed component. The article of footwear further includes an exterior braided layer. An inner surface of the exterior braided layer is attached to a lower surface of the footbed component. Further, the interior braided layer is attached to the exterior braided layer.

In another embodiments, an article of footwear includes a footbed component, an interior layer, where an outer surface of the interior layer is attached to an upper surface of the footbed component. The article also includes an exterior layer, the exterior layer being a braided layer. An inner surface of the exterior layer is attached to a lower surface of the footbed component. The interior layer is attached to the exterior layer. The interior layer and exterior layer are made of dissimilar materials.

In another embodiment, an article of footwear includes an upper that incorporates a braided component. The braided component includes a first portion and a second portion. Further, the braided component has a unitary braided construction such that the first portion is continuous with the second portion. The first portion forms a first braided layer of the upper. Additionally, the second portion forms a second braided layer of the upper. Additionally, a portion of the second braided layer overlaps a portion of the first braided layer.

In another aspect, a method of making an article of footwear includes attaching a plate to the bottom of a first layer, the first layer being disposed on a last, wherein the plate has at least one hole. The method also includes inserting a deflector into the at least one hole, and passing the last with the first layer, the plate and the cleat through a braiding machine and forming a second layer around the first layer and the plate. The second layer is a braided layer and the deflector extends through the second layer.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
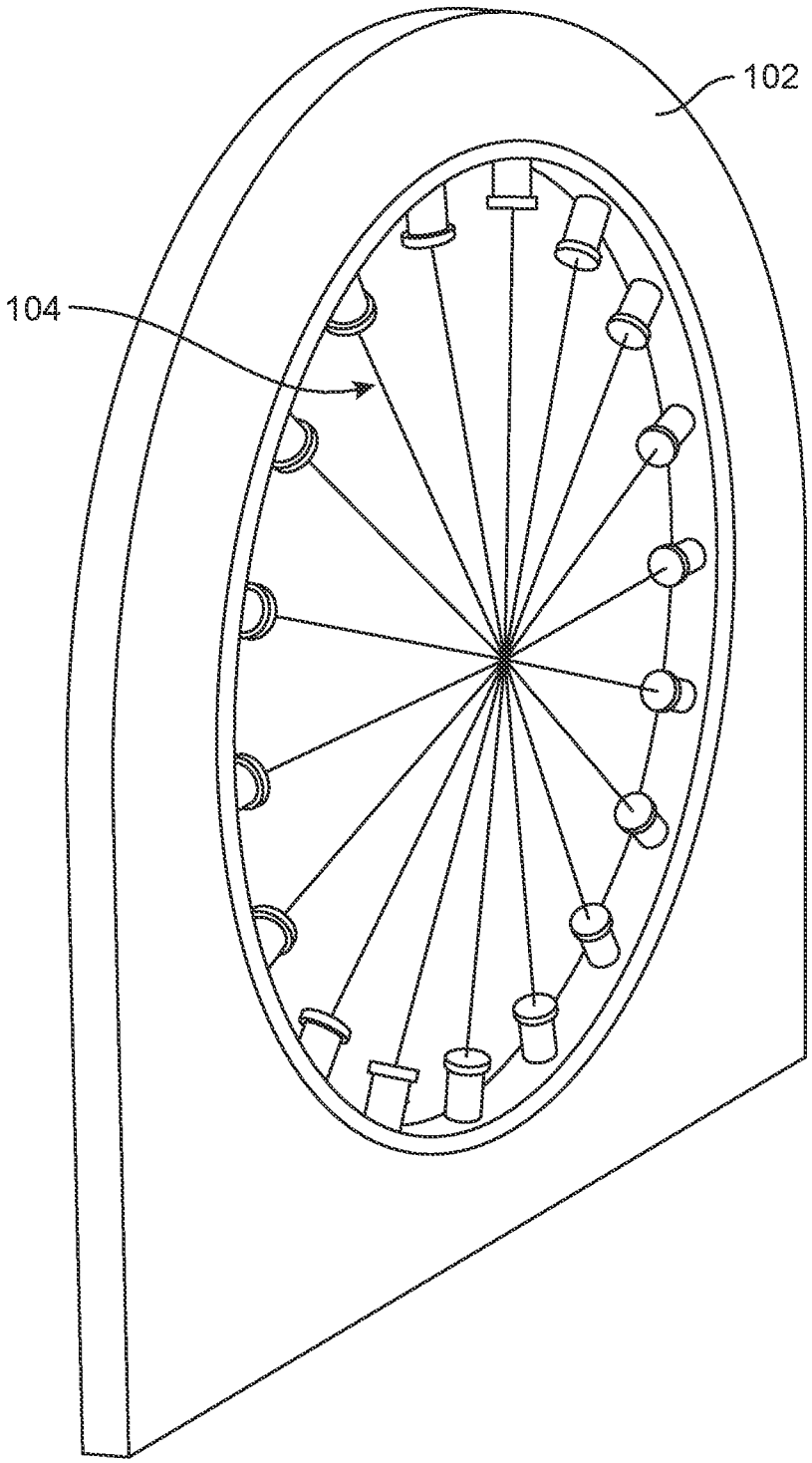
FIG. 1 is a schematic view of an embodiment of a braiding machine.

In the following detailed description, reference is made to the accompanying figures that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment," "an embodiment," "an exemplary embodiment," and the like indicates that the embodiment described may include a particular feature, structure, or characteristic that may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structure, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

As used herein, the term "article" refers broadly to articles of footwear, articles of apparel (e.g., clothing), as well as accessories and/or equipment. Articles of footwear include, but are not limited to, hiking boots, soccer shoes, football shoes, sneakers, running shoes, cross-training shoes, rugby shoes, basketball shoes, baseball shoes as well as other kinds of shoes. Moreover, in some embodiments, components may be configured for various kinds of non-sports-related footwear, including, but not limited to, slippers, sandals, high-heeled footwear, loafers as well as any other kinds of footwear. Articles of apparel include, but are not limited to, socks, pants, shorts, shirts, sweaters, undergarments, hats, gloves, as well as other kinds of garments. Accessories include scarves, bags, purses, backpacks, as well as other accessories. Equipment may include various kinds of sporting equipment including, but not limited to, bats, balls, various sporting gloves (e.g., baseball mitts, football gloves, ski gloves, etc.), golf clubs, as well as other kinds of sporting equipment.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

For purposes of general reference, an article of footwear and associated components such as a last, may be divided into three regions: a forefoot region, a midfoot region, and a heel region. The forefoot region may be generally associated with the toes and joints connecting the metatarsals with the phalanges. The midfoot region may be generally associated with the arch of a foot, including the instep. Likewise, the heel region or "hindfoot" may be generally associated with the heel of a foot, including the calcaneus bone. For purposes of this disclosure, the following directional terms, when used in reference to an article of footwear, shall refer to the article of footwear when sitting in an upright position, with the sole facing the ground, that is, as it would be positioned when worn by a wearer standing on a substantially level surface.

The term "longitudinal," as used throughout this detailed description and in the claims, refers to a direction extending along the length of a component. For example, a longitudinal direction of an article of footwear extends from the forefoot region to the heel region of the article of footwear.

The term "forward" or "front" is used to refer to the general direction in which the toes of a foot point, and the term "rearward" or "back" is used to refer to the opposite direction, i.e., the direction in which the heel of the foot is facing.

The term "lateral direction," as used throughout this detailed description and in the claims, refers to a side-to-side direction extending along the width of a component. In other words, the lateral direction may extend between a medial side and a lateral side of an article of footwear or last, with the lateral side of the article of footwear being the surface that faces away from the other foot, and the medial side being the surface that faces toward the other foot.

The term "vertical," as used throughout this detailed description and in the claims, refers to a direction generally perpendicular to both the lateral and longitudinal directions. For example, in cases where an article of footwear is planted flat on a ground surface, the vertical direction may extend from the ground surface upward. It will be understood that each of these directional adjectives may be applied to individual components of an article of footwear. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The term "side," as used in this specification and in the claims, refers to any portion of a component facing generally in a lateral, medial, forward, or rearward direction, as opposed to an upward or downward direction. The term "lateral side" refers to any component facing in general toward the lateral direction. The term "medial side" refers to any component facing in general toward the medial direction.

The embodiments may incorporate an insole, a midsole, a plate, and/or other elements. For purposes of clarity, the term "footbed component" may be used throughout this detailed description and in the claims to refer to either a midsole, plate or other similar element. That is, a "footbed component" may be any component that provides structure and support for resting a food, and which may generally provide more structure and support than some textile layers.

Double Layer Articles

FIG. 1 depicts an embodiment of a braiding machine. Braiding machine 102 includes a plurality of spools that include strands or threads. The spools pass by one another along a track such that plurality of strands 104 intertwine and twist with one another. This twisting and intermeshing of plurality of strands 104 forms a braided structure. Although depicted as a radial braiding machine, it should be recognized that an axial braiding machine or other type of braiding machine may be utilized. Further, the braiding machine may also be configured to perform jacquard and non-jacquard motions. An example of a braiding machine is described in Richardson, U.S. Pat. No. 5,257,571, granted Nov. 2, 1993, entitled "Maypole Braider Having a Three Under and Three Over Braiding Path," the entirety of which is hereby incorporated by reference. Additionally, another example of a braiding machine is described in Dow et al., U.S. Pat. No. 7,908,956, granted Mar. 22, 2011, entitled "Machine for Alternating Tubular and Flat Braid Sections," the entirety of which is hereby incorporated by reference. An example that includes a former that is passed through a braiding machine is described in Dodge et al., U.S. Pat. No. 376,372, granted Jan. 10, 1888, entitled "Manufacture of Woolen Boots," the entirety of which is hereby incorporated by reference.

Braiding machine 102 may be utilized to overbraid an object. "Overbraid" as used herein shall refer to a method of braiding that forms the shape of a three-dimensional structure. An object or structure that is overbraided includes a braid structure that extends around an outer surface of the structure. An object need not be completely covered by a braid structure to be considered overbraided. Rather, an object that is overbraided includes a seamless braided structure that extends around a portion of the object. As an object is overbraided, strands are deposited along an outer surface of the object.

An object is overbraided as the object passes through the braiding point. The braiding point is defined as the point or area where plurality of strands 104 consolidate to form a braided structure. As plurality of strands 104 approach the braiding point, the distance between each of the strands is diminished. As the distance between the strands reduces, the strands from the different spools intermesh or braid with one another in a tighter fashion. The braiding point refers to an area where the desired tightness or strand density has been achieved on the braiding machine.

Figure 2:
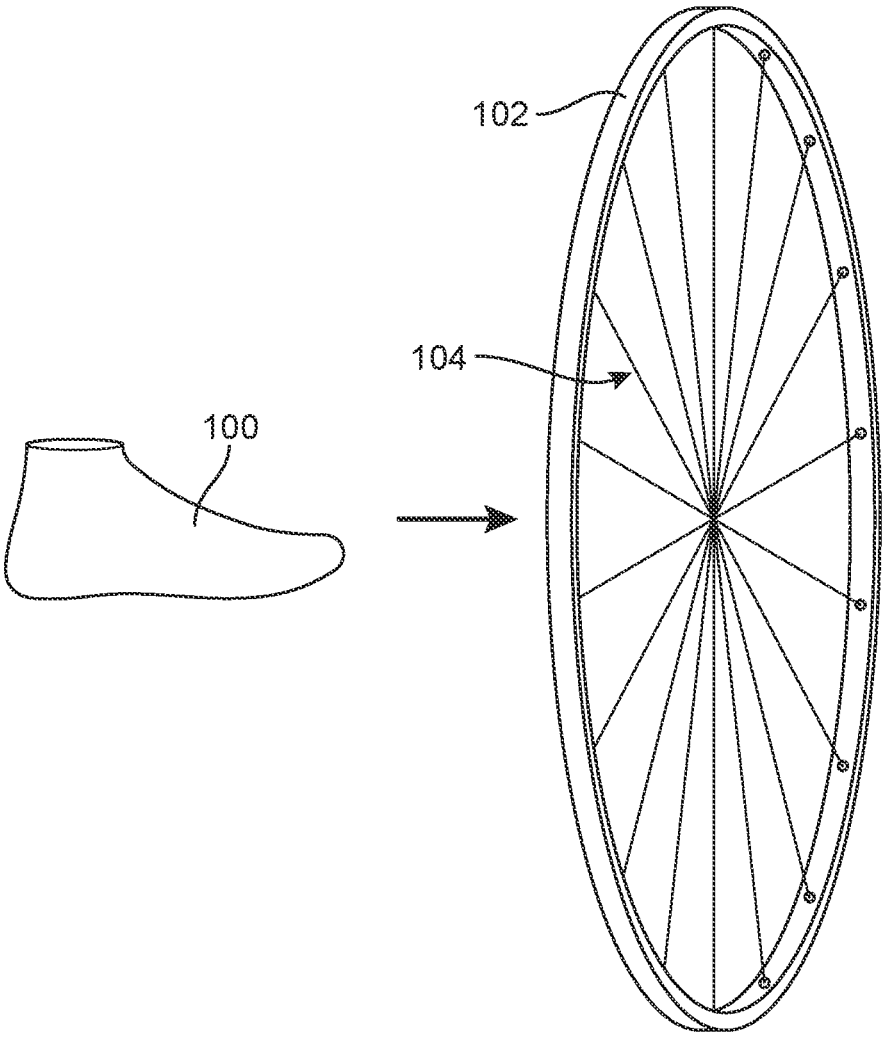
FIG. 2 is a schematic view of an embodiment of a last and a braiding machine.
Figure 3:
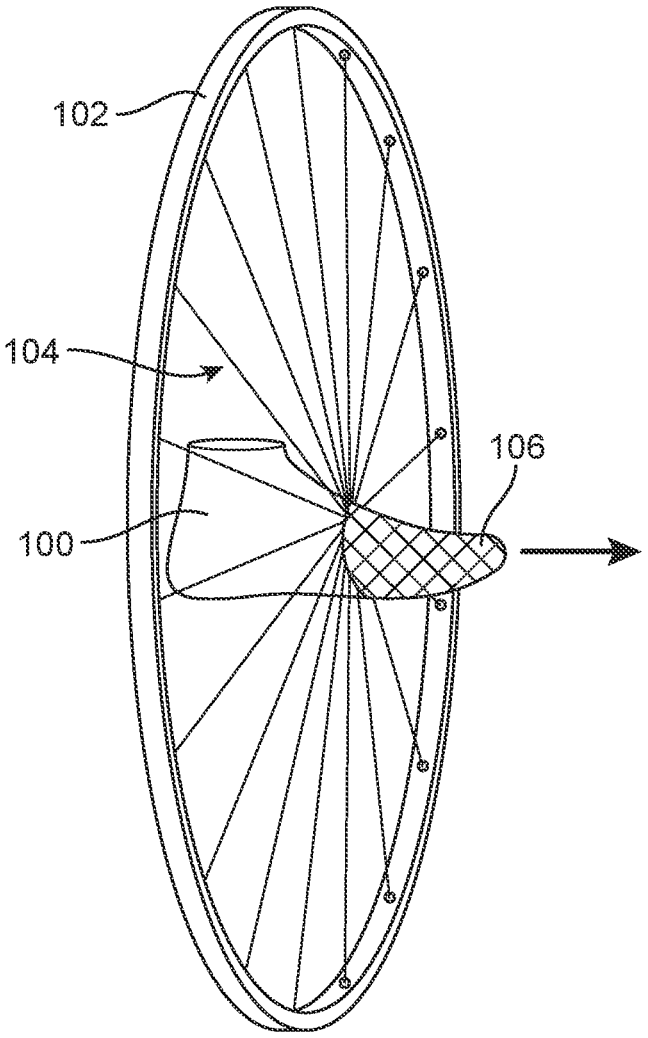
FIG. 3 is a schematic view of an embodiment of a last passing through a braiding machine.
Figure 4:
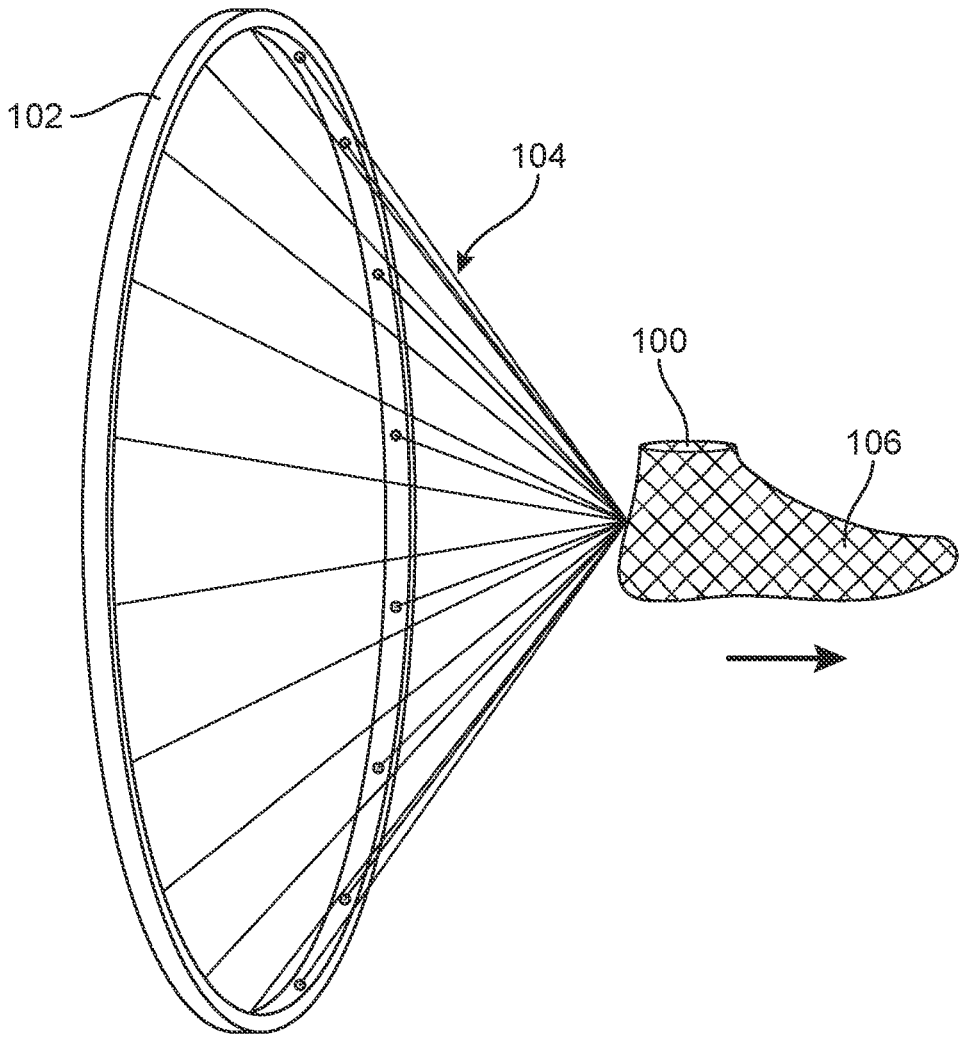
FIG. 4 is a schematic view of an embodiment of a last passing through a braiding machine.

The following figures depict methods and apparatuses used to form an article of footwear. In some embodiments, an article of footwear may be formed in conjunction with a braiding machine. As shown in FIGS. 2-4 last 100 is passed through braiding machine 102. To assist in clearly depicting the method used to form an article incorporating a braided component, braiding machine 102 is depicted without spools or a support structure in the following figures. Although depicted without a support structure or spools, it should be recognized that braiding machine 102 as well as other braiding machines depicted in this detailed description may include spools and strands or threads. As last 100 passes through the braiding point of braiding machine 102, plurality of strands 104 is deposited along the outer surface of last 100. In this manner, last 100 may be overbraided by plurality of strands 104, forming an interior braided layer such as first braided layer 106. In some embodiments, various objects with different shapes may be passed through braiding machine 102. For example, in some embodiments, objects that are shaped as baseball bats, hockey sticks, torsos, pants or gloves may be passed through the braiding point of braiding machine 102. In other embodiments, various other differently shaped objects may be utilized.

As shown, last 100 is overbraided with first braided layer 106. In some embodiments however, last 100 may not be overbraided. For example, a woven, non-woven, knit, or other configuration of material may be placed over or around last 100. In some embodiments, a sock-shaped article may be placed around last 100. That is, in some embodiments, a previously formed shaped material may be placed around last 100.

Plurality of strands 104 may be formed of different materials. The properties that a particular strand will impart to an area of a braided structure depend on the materials that form the various filaments and fibers within the strands. For example, the filaments may be formed of cotton. Cotton may provide a soft hand, natural aesthetics as well as biodegradability. Other embodiments may include elastane or stretch polyester. In still further embodiments, nylon may be incorporated. Nylon is a durable, abrasion-resistant material with relatively high strength that may be incorporated into areas of an article of footwear that are more likely to be exposed to high stress or scraping than other areas. Polyester may be incorporated due to its hydrophobic nature. For example, a waterproof or water-resistant article may incorporate polyester. Additionally, various materials may be utilized for sweat removal or wicking. The materials chosen may also include properties that permit the material to melt or bond to various components. For example, the materials may include thermoplastic or thermoset materials as well as other heat-activated materials. Additionally, other materials may be utilized for various material properties. In addition to material, other aspects of the strand may be altered to affect the properties of the braided structure. For example, a strand may include monofilament or multifilament thread. The strand may also include separate filaments that are formed of different materials, such as bicomponent strands. As shown in the figures, first braided layer 106 may be formed of a soft material such as cotton. The soft material may provide a comfortable surface to a wearer of an article of footwear incorporating first braided layer 106.

In some embodiments, as last 100 is passed through braiding machine 102, plurality of strands 104 extend between braiding machine 102 and last 100. For example, as shown in FIG. 4, plurality of strands 104 extend beyond the braiding point between braiding machine 102 and first braided layer 106. Therefore, in some embodiments, plurality of strands 104 may be cut so that last 100 and first braided layer 106 may be moved for additional processing. In some embodiments, shears or a blade may be used to cut plurality of strands 104. In other embodiments, lasers may be utilized. In still further embodiments, heat may be used to melt plurality of strands 104 to assist in removal of first braided layer 106 from braiding machine 102.

Figure 5:
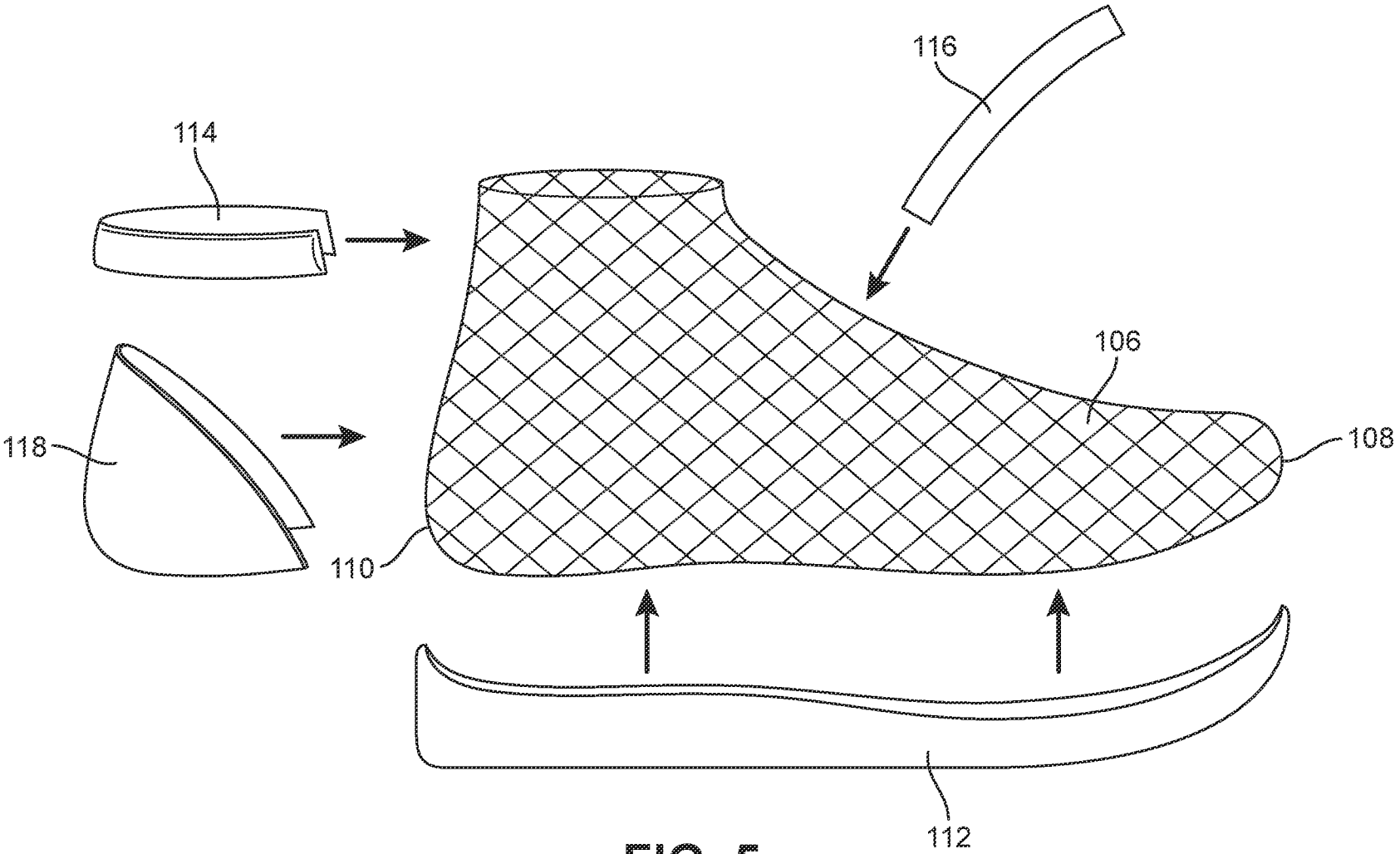
FIG. 5 is schematic view of an embodiment of a braided layer and additional components.
Figure 6:
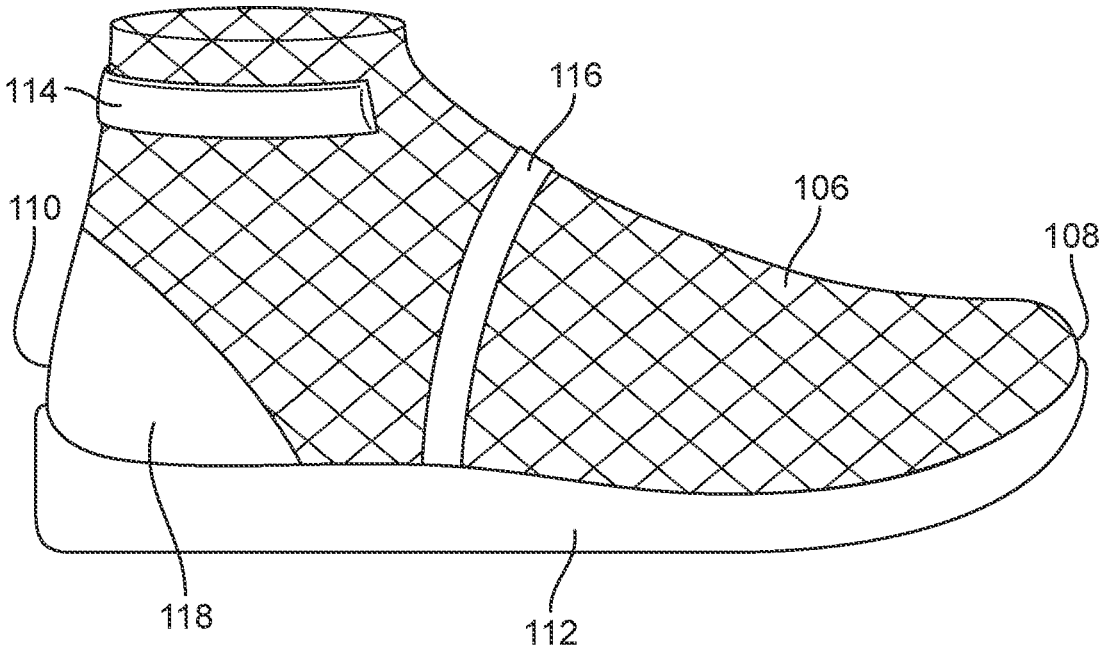
FIG. 6 is a schematic view of an embodiment of components attached to the braided layer.

Referring to FIGS. 5 and 6, first braided layer 106 may be subjected to further processing. As shown, excess strands of plurality of strands 104 may be trimmed such that toe edge 108 and heel edge 110 are substantially flush with last 100. Toe edge 108 and heel edge 110 may be formed by stitching, bonding using adhesives or thermoplastic material, or finished using various techniques. As shown in FIGS. 5 and 6 various components may be attached to first braided layer 106. As shown, midsole 112 is attached to a portion of first braided layer 106 adjacent to a lower surface of last 100. Midsole 112 may be formed of a material that attenuates ground reaction forces to lessen stresses upon the foot and leg during walking, running, and other ambulatory activities. For example, midsole 112 may be formed of polymer foam or a fluid-filled chamber. Collar cushion 114 is attached along an ankle portion of first braided layer 106 and may wrap from a lateral side to a medial side of first braided layer 106. Collar cushion 114 may be formed of a cushioning material such as foam and may be particularly placed to align with the ankle of a user. Additional cushioning may be attached to specific areas associated with pressure points to reduce scraping while providing additional support to a user. Additionally, support structure 116 may also be attached to first braided layer 106. Support structure 116 may extend from midsole 112 toward a throat area of first braided layer 106. Support structure 116 may be formed of material with sufficient rigidity or stiffness that provides vertical support to first braided layer 106. For example, support structure 116 may be formed of a rigid material such as carbon fiber, hard plastic, or other material. Further, support structure 116 may be formed of a material that may be hardened through a curing process. Heel counter 118 extends around heel edge 110 of first braided layer 106. Heel counter 118 may be formed of a stiff material to provide support in the heel region of an article of footwear incorporating first braided layer 106. Additionally, various other components may be attached to first braided layer 106 at various locations. For example, a reinforcement piece may be placed in the throat area to provide support for a future eyelet. Additionally, it should be recognized that support stiffeners or additional support members may be placed in various positions along first braided layer 106. For example, a toe cap may also be attached to first braided layer 106.

The various components attached to first braided layer 106 may be attached or adhered using various techniques. In some embodiments, the components may be sewn into first braided layer 106. In other embodiments, the components may be adhered using glue or other adhesive. In still further embodiments, the components may be attached with varying degrees of shear stress resistance. That is, in some embodiments, for example, collar cushion 114 may be adhered using a tacky type substance that secures collar cushion 114 in place but is easily removable. Midsole 112, support structure 116, and heel counter 118 may be adhered using adhesives that securely fasten midsole 112, support structure 116, and heel counter 118 such that midsole 112, support structure 116, and heel counter 118 may be permanently secured to first braided layer 106. For example, the magnitude of force required to remove collar cushion 114 may be less than the force required to remove other components attached to first braided layer 106. These various types of attachments may permit collar cushion 114 to be semi-movable within a pocket formed from braided structures within an article of footwear.

Figure 7:
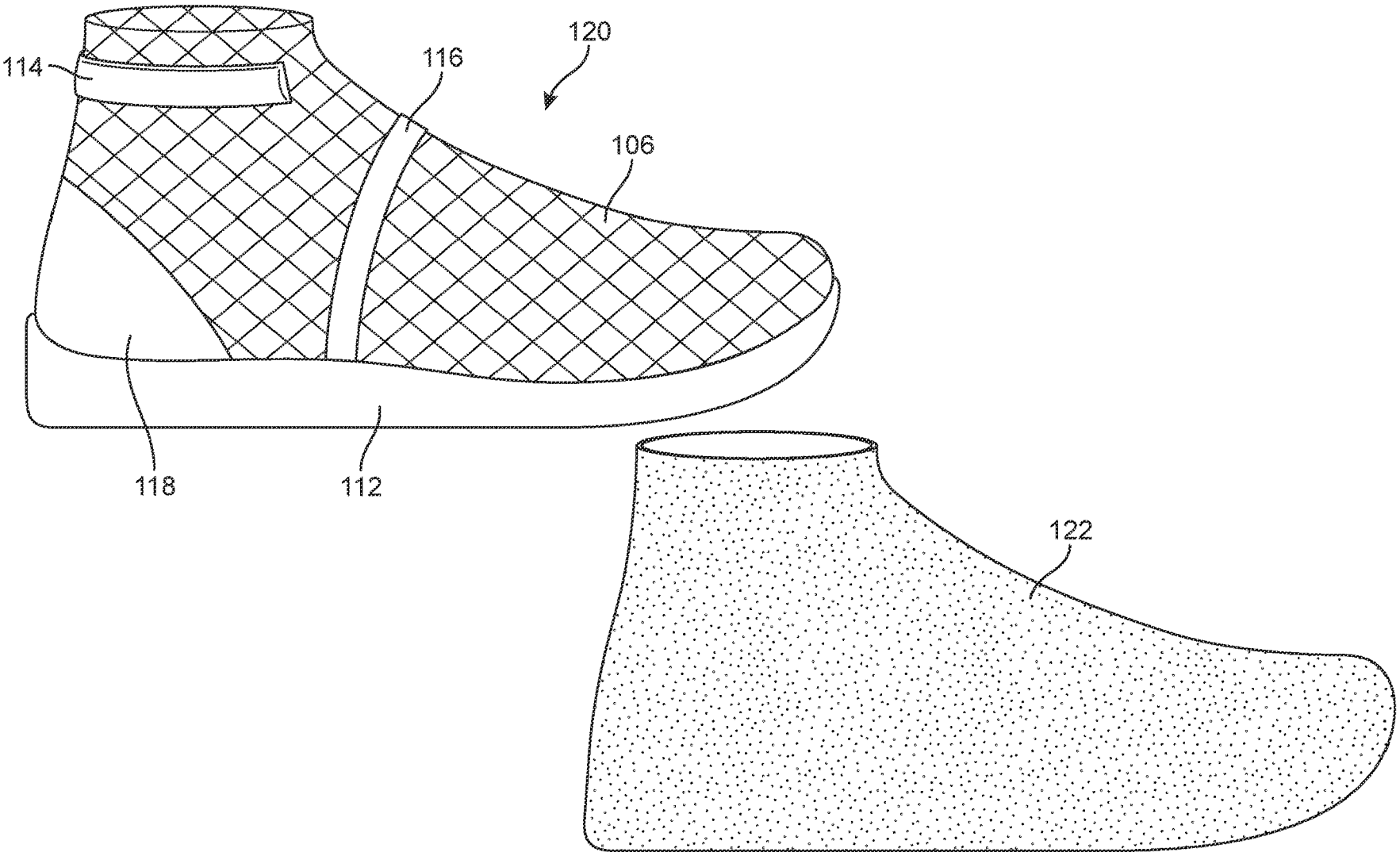
FIG. 7 is a schematic view of an embodiment of an interior braid assembly and an adhesion layer.
Figure 8:
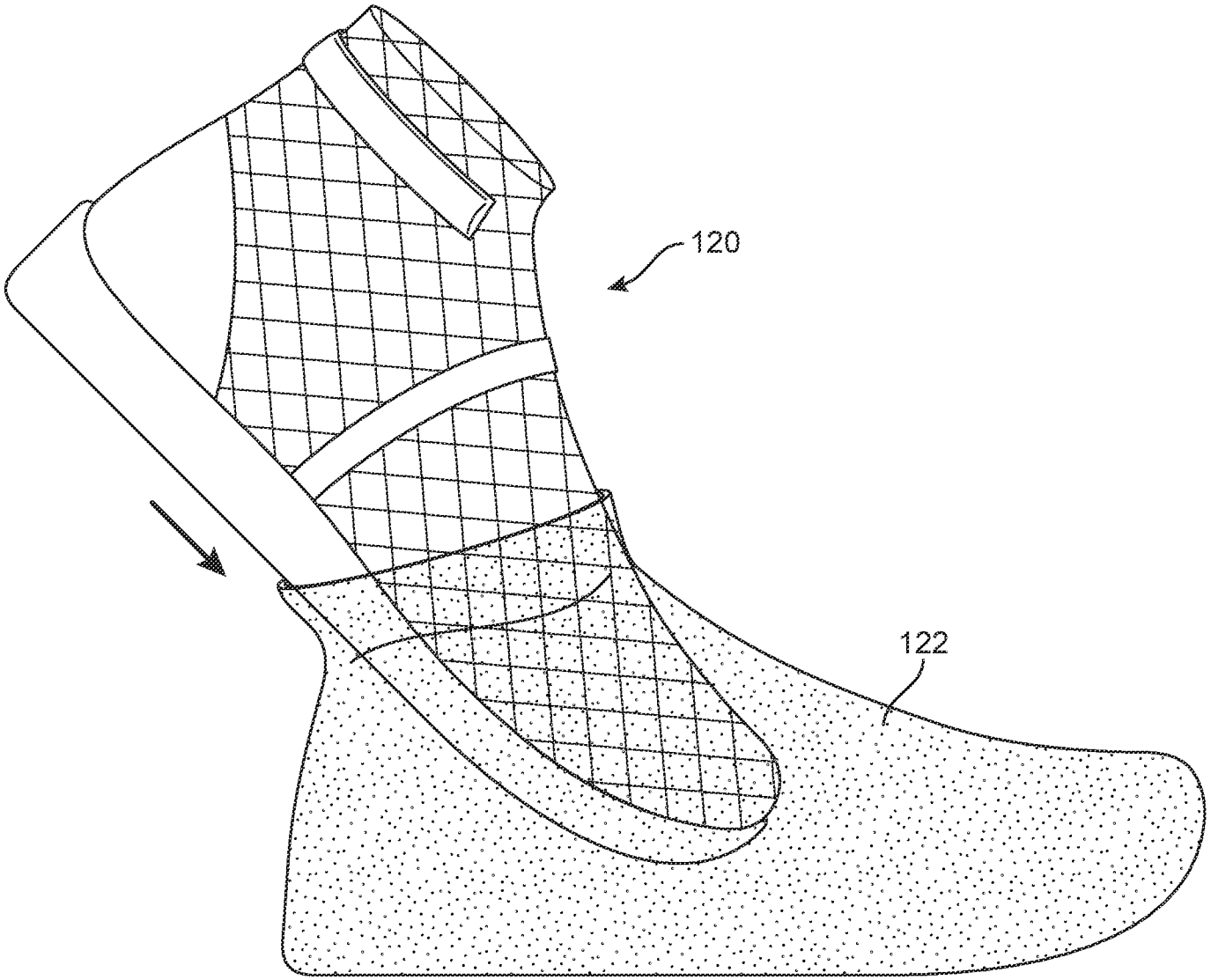
FIG. 8 is schematic view of an embodiment of an interior braid assembly being inserted into an adhesion layer.
Figure 9:
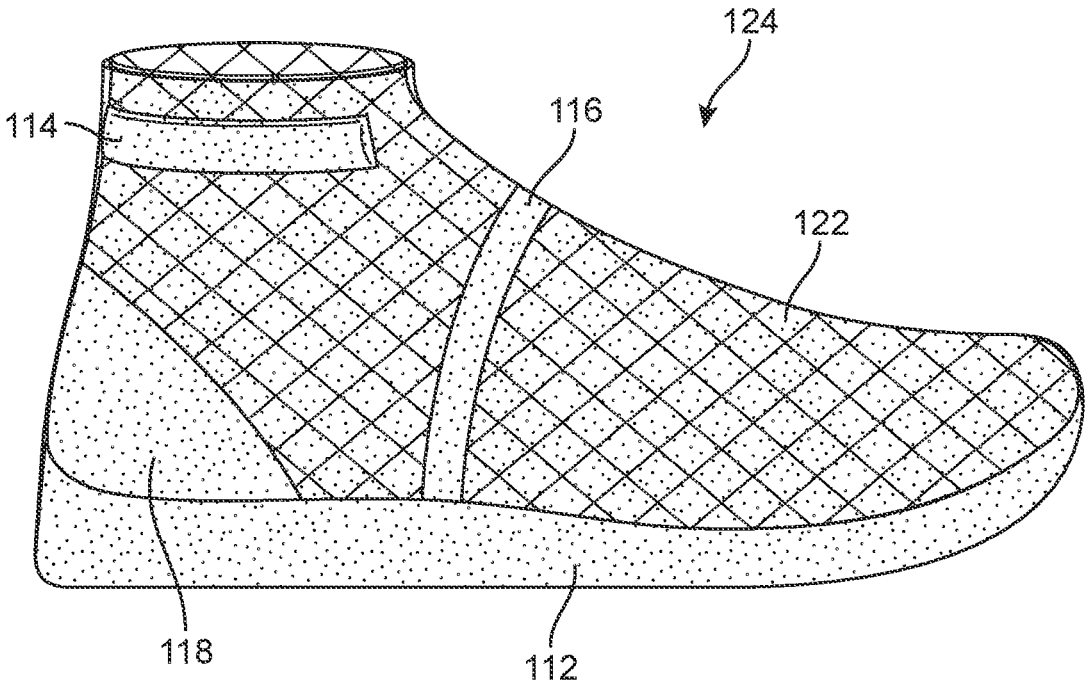
FIG. 9 is a schematic view of an embodiment of an adhesion braid assembly.

After various structures are attached to first braided layer 106, an additional layer may be placed over the braid assembly. In some embodiments, the additional layer may be an adhesion layer. As shown in FIGS. 7-9, interior braid assembly 120 is inserted into adhesion layer 122. In other embodiments, adhesion layer 122 may be secured to first braided layer 106 before any additional structures are attached to first braided layer 106. That is, in some embodiments, adhesion layer 122 may be located between first braid layer 106 and midsole 112, collar cushion 114, support structure 116, and heel counter 118. In other embodiments, adhesion layer 122 may be located between first braid layer 106 and midsole 112; however, collar cushion 114, support structure 116, and heel counter 118 may be located between first braid layer 106 and adhesion layer 122. In still further embodiments, an adhesion layer may not be utilized. In the embodiment as shown, adhesion layer 122 is attached to or surrounds interior braid assembly 120.

As shown in FIGS. 7-9, adhesion layer 122 is formed in the shape of interior braid assembly 120. Although depicted as a particular shape, in some embodiments, adhesion layer 122 may be particularly formed around interior braid assembly 120. Interior braid assembly 120 may be passed through a separate braiding machine. The second braiding machine may include different strands than braiding machine 102. The second braiding machine may be utilized to overbraid interior braid assembly 120 such that adhesion layer 122 is deposited along the surface of interior braid assembly 120 in a similar manner as first braided layer 106 is deposited along the surface of last 100. In another embodiment, the spools within braiding machine 102 may be replaced with spools containing different strands to be utilized in adhesion layer 122. In still further embodiments, adhesion layer 122 may be formed in various manners. For example, in some embodiments, adhesion layer 122 may be woven, knit, non-woven, or any other type of configuration.

In some embodiments, adhesion layer 122 may be activated after formation. In some embodiments, adhesion layer 122 may include thermoplastic or thermoset materials such as thermoplastic urethane (TPU). In still other embodiments, adhesion layer 122 may be formed of material that is activated when the material is subjected to heat. In other embodiments, adhesion layer 122 may be activated through other techniques after application around interior braid assembly 120.

In some embodiments, adhesion layer 122 may be activated to secure the various components to first braided layer 106. For example, in some embodiments midsole 112, collar cushion 114, support structure 116, and heel counter 118 may be secured to first braided layer 106 through the use of adhesion layer 122 such that the components are located between first braided layer 106 and adhesion layer 122. In this manner, the components may be sandwiched by adhesion layer 122. In other embodiments, adhesion layer 122 may be wrapped around first braided layer 106 prior to attachment of any additional components. Components may then be placed along an outer surface of adhesion layer 122. Then adhesion layer 122 may be activated such that the components are secured to the outer surface of adhesion layer 122 and first braided layer 106. In other embodiments, adhesion layer 122 may be utilized to prepare interior braid assembly 120 for attachment with other components or layers. FIG. 9 depicts interior braid assembly 120 enveloped by adhesion layer 122. This combination of layers is referred to as adhesion braid assembly 124.

Figure 10:
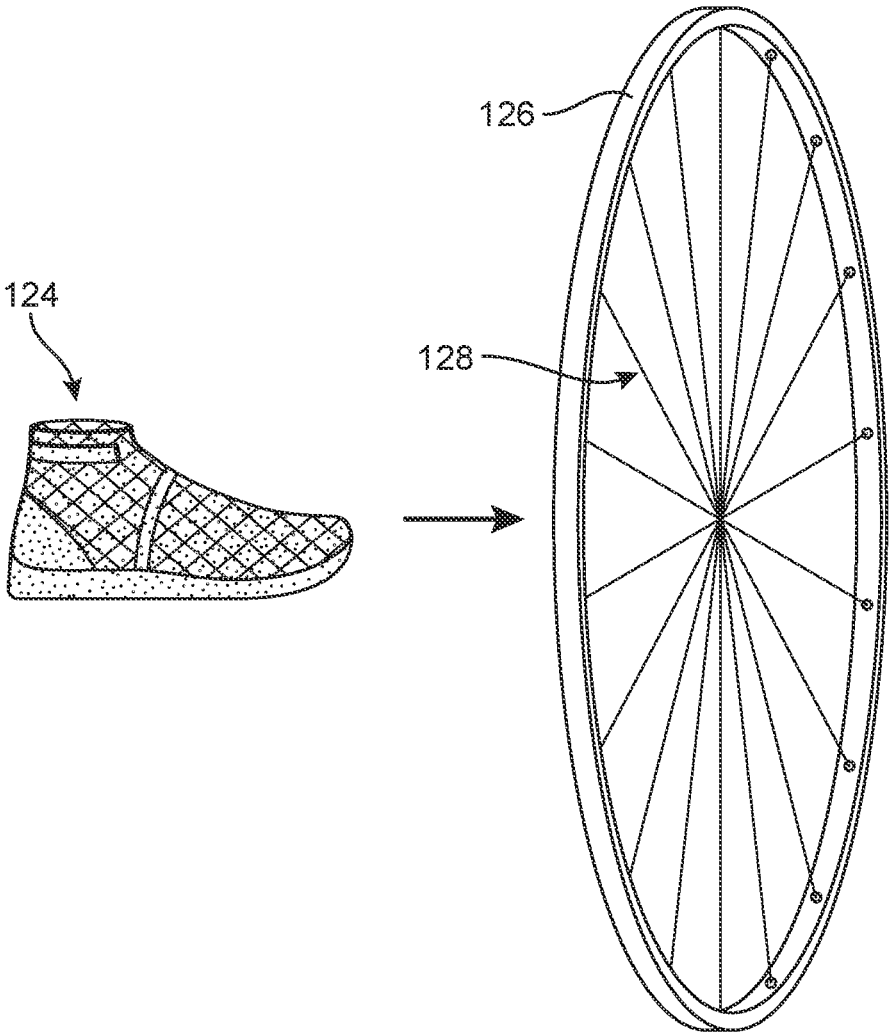
FIG. 10 is a schematic view of an embodiment of an adhesion braid assembly and a braiding machine.
Figure 11:
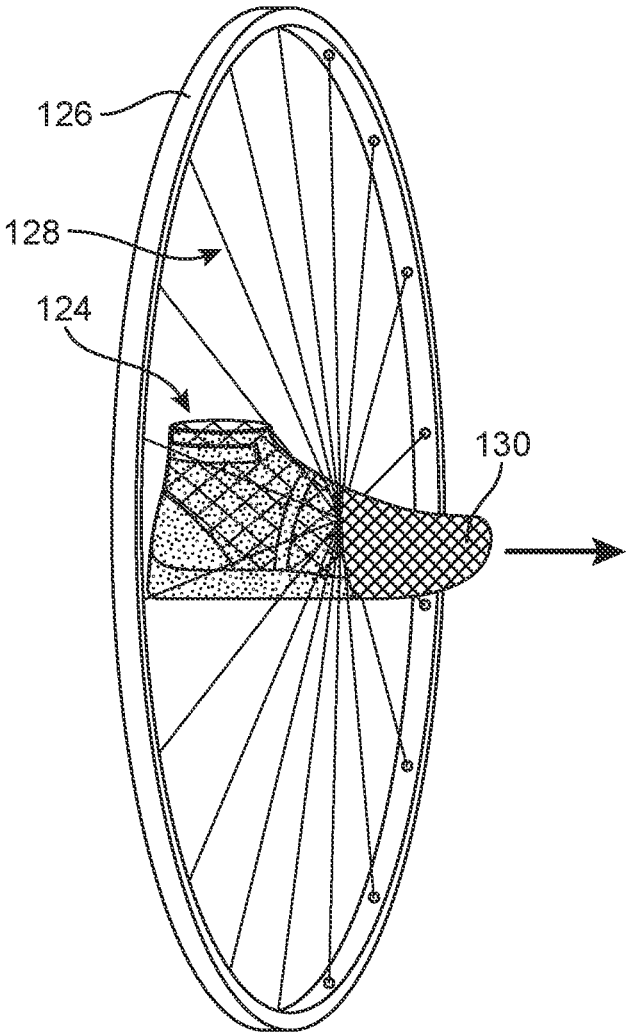
FIG. 11 is a schematic view of an embodiment of an adhesion braid assembly passing through a braiding machine.
Figure 12:
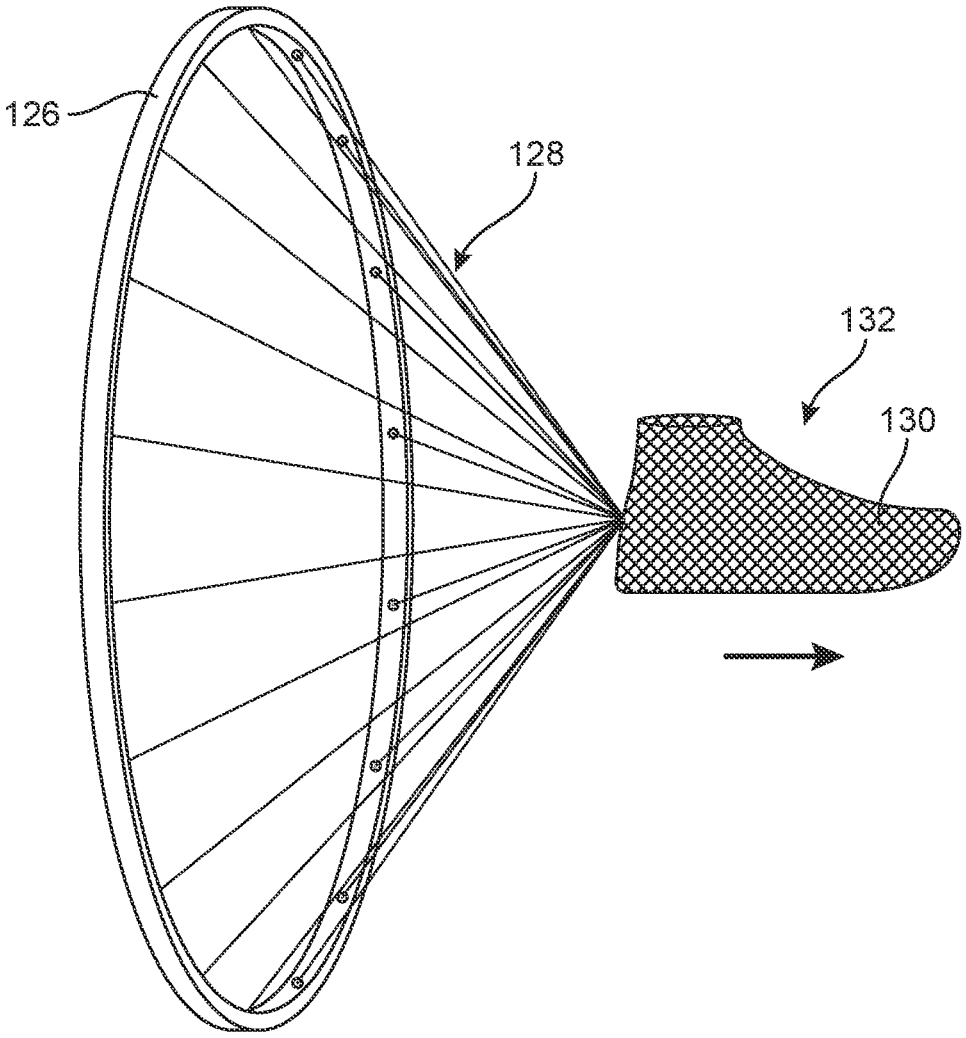
FIG. 12 is a schematic view of an embodiment of a braided layer deposited along the adhesion braid assembly.

After the adhesion layer is positioned around interior braid assembly 120, adhesion braid assembly 124 may be passed through a braiding machine. As depicted in FIGS. 10-12, adhesion braid assembly 124 passes through braiding machine 126. In some embodiments, braiding machine 126 may be equipped with plurality of strands 128 that are formed of different material than plurality of strands 104 used to form first braided layer 106. In other embodiments, braiding machine 102 may be utilized; however, the strands of braiding machine 102 may be changed. In still further embodiments, adhesion braid assembly 124 may be passed through braiding machine 102 and overbraided by plurality of strands 104. Braiding machine 126 deposits plurality of strands 128 along the outer surfaces of adhesion braid assembly 124. In this manner, adhesion braid assembly 124 is overbraided by plurality of strands 128 and an exterior braided layer such as second braided layer 130 is formed around adhesion braid assembly 124. The combination of second braided layer 130 and adhesion braid assembly 124 is referred to as upper braid assembly 132.

Various types of materials with various material properties may be utilized to form second braided layer 130. In some embodiments, the strands of plurality of strands 128 are formed of material that is abrasion resistant. In other embodiments, plurality of strands 128 may be formed of material that is water resistant or waterproof. In still further embodiments, plurality of strands 128 may include thermoplastic urethane or other bondable material. In other embodiments, plurality of strands 128 may be the same material as plurality of strands 104. In some embodiments, plurality of strands 128 may be soft, stretchable material, while in other embodiments, plurality of strands 128 may be hard and rigid. As depicted, strands of plurality of strands 128 are abrasion resistant and are formed of a durable material. Further, strands of plurality of strands 128 may have a lower modulus of elasticity than plurality of strands 104. Further, plurality of strands 128 may have a greater tensile strength than plurality of strands 104.

Figure 13:
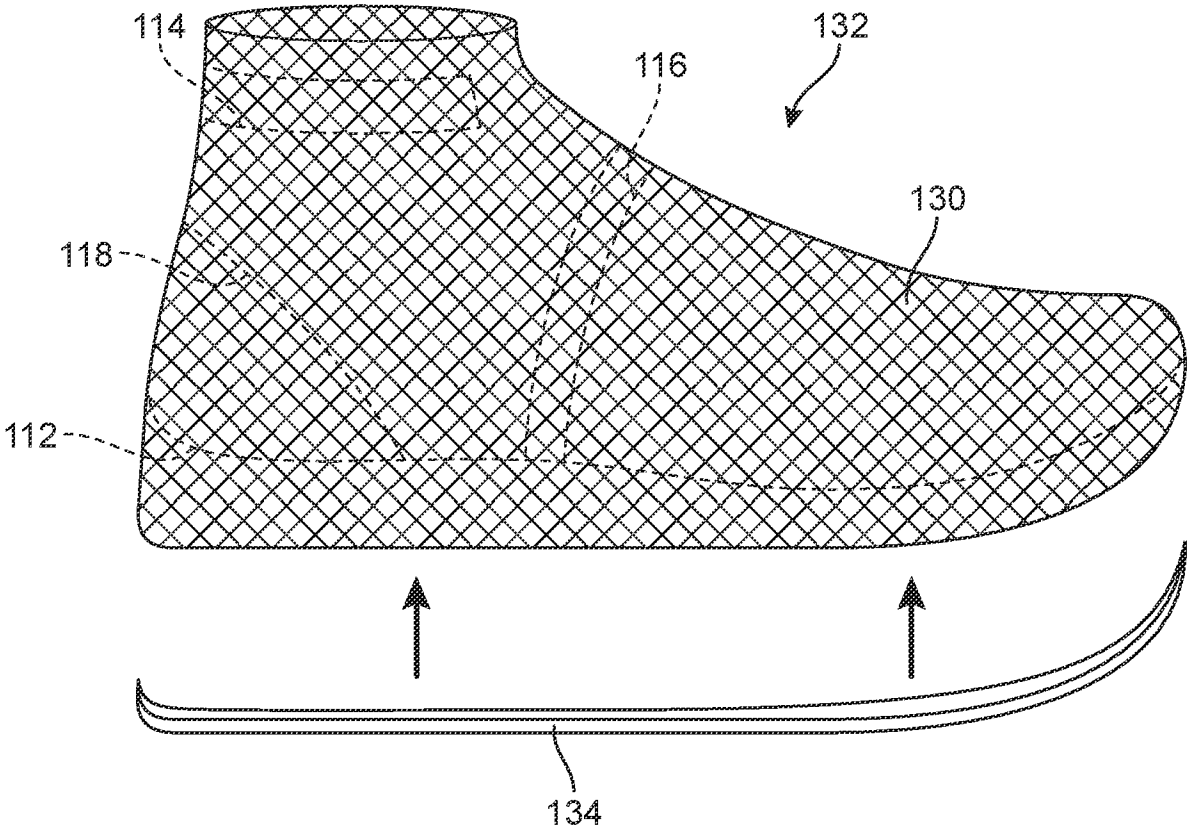
FIG. 13 is a schematic view of an embodiment of an upper braid assembly and additional components.
Figure 14:
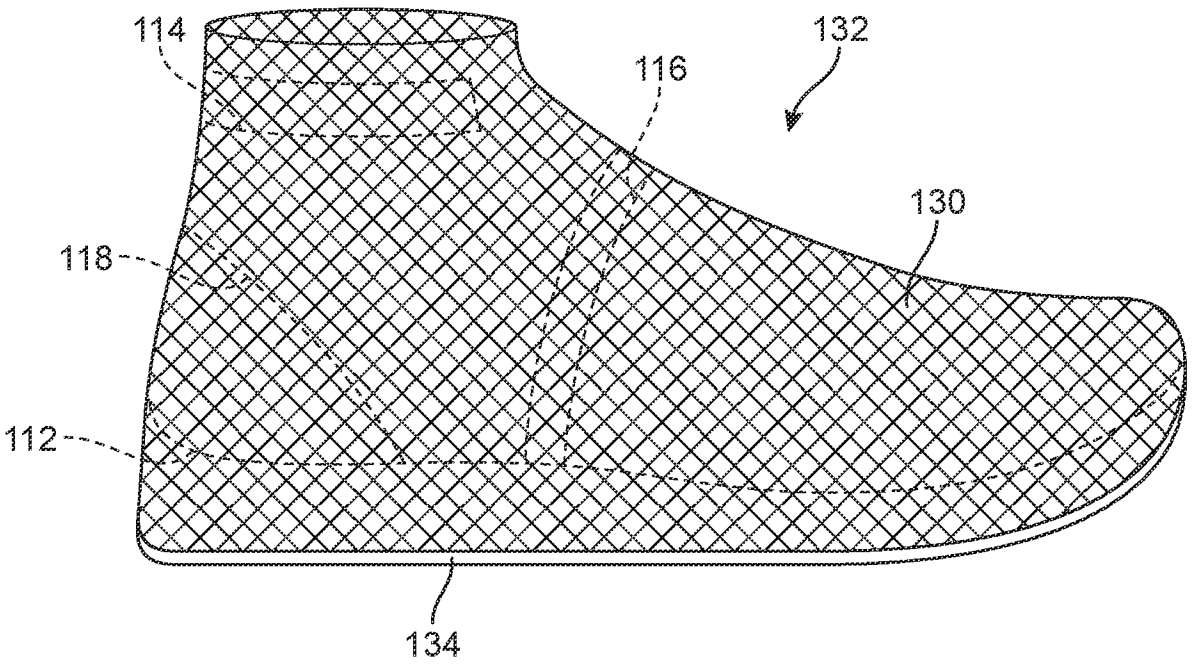
FIG. 14 is a schematic view of an embodiment of an upper braid assembly with an outsole.

Referring now to FIG. 13, second braided layer 130 is depicted around last 100 and adhesion braid assembly 124, thereby forming upper braid assembly 132. As shown, collar cushion 114, support structure 116, heel counter 118, and midsole 112 are all covered by second braided layer 130. In this manner, each of the components is sandwiched between adhesion layer 122 and second braided layer 130. In embodiments that do not include adhesion layer 122, each of the components may be sandwiched between first braided layer 106 and second braided layer 130. As shown in FIGS. 13-18, additional post processing may be performed such as the addition of outsole 134. Outsole 134 may be attached by adhesive or other technique. Additionally, outsole 134 may become secured when subjected to heat. That is, the material used to attach outsole 134 to upper braid assembly 132 may be heat activated. In other embodiments, other features may be added to upper braid assembly 132 to form an article of footwear. For example, logos may be stitched or adhered to second braided layer 130. Additionally, further support structures may be stitched or otherwise adhere to second braided layer 130 to provide additional structural support to the article.

Figure 15:
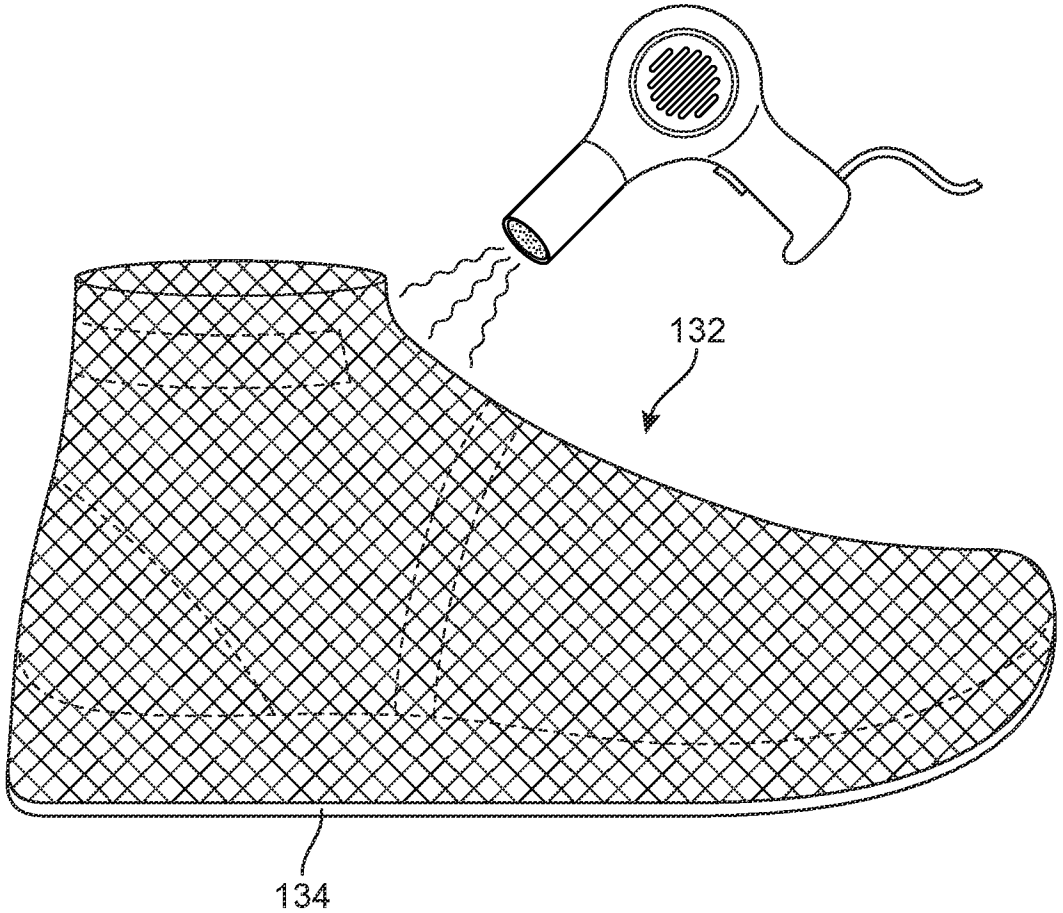
FIG. 15 is a schematic view of an embodiment of an upper braid assembly subjected to heat.

Referring now to FIG. 15, upper braid assembly 132 may be subjected to heat or other bonding process. As shown, a forced air heater is utilized; however, other embodiments may incorporate different techniques for bonding the layers of upper braid assembly 132. In some embodiments, a laser may be utilized. In other embodiments, last 100 may be formed of aluminum or steel. Last 100 may then be heated such that the layers of upper braid assembly 132 bond to each other. Additional bonding techniques or processes may be incorporated to bond or secure each of the layers and components of upper braid assembly 132 together. In some embodiments, adhesion layer 122 may be heat activated. By activating adhesion layer 122, first braided layer 106 and second braided layer 130 may be bonded together. By bonding first braided layer 106 with second braided layer 130, a unitary feel of upper braid assembly 132 may be achieved. That is, in some embodiments, first braided layer 106 and second braided layer 130 may move or react as a single piece of material rather than separated as first braided layer 106 and second braided layer 130. In other embodiments, heat may be applied at various stages during the manufacturing process. For example, in some embodiments, adhesion layer 122 may be subjected to heat or other activating process before second braided layer 130 is applied to adhesion braid assembly 124. Therefore, adhesion layer 122 may be utilized to secure various components to first braided layer 106.

In some embodiments, heat may be applied in specific areas of upper braid assembly 132. By heating specific areas of upper braid assembly 132, particular areas may be "locked in" or secured in a particular location. For example, in some embodiments, the forefoot area of upper braid assembly 132 may be subjected to heat or spot welded. This heat may cause the particular area of upper braid assembly 132 to melt and secure first braided layer 106 with second braided layer 130. This selective securement of areas of upper braid assembly 132 may allow for breathability in particular areas of upper braid assembly 132 and rigidity in other areas of upper braid assembly 132. Additionally, in some embodiments, adhesion layer 122 may not be present. In some embodiments, first braided layer 106 and second braided layer 130 may incorporate TPU or another bonding material. When heat is applied to particular areas of upper braid assembly 132, TPU from first braided layer 106 and TPU from second braided layer 130 may interact with one another and solidify. In this manner, particular areas of upper braid assembly 132 may be secured to each other.

Figure 16:
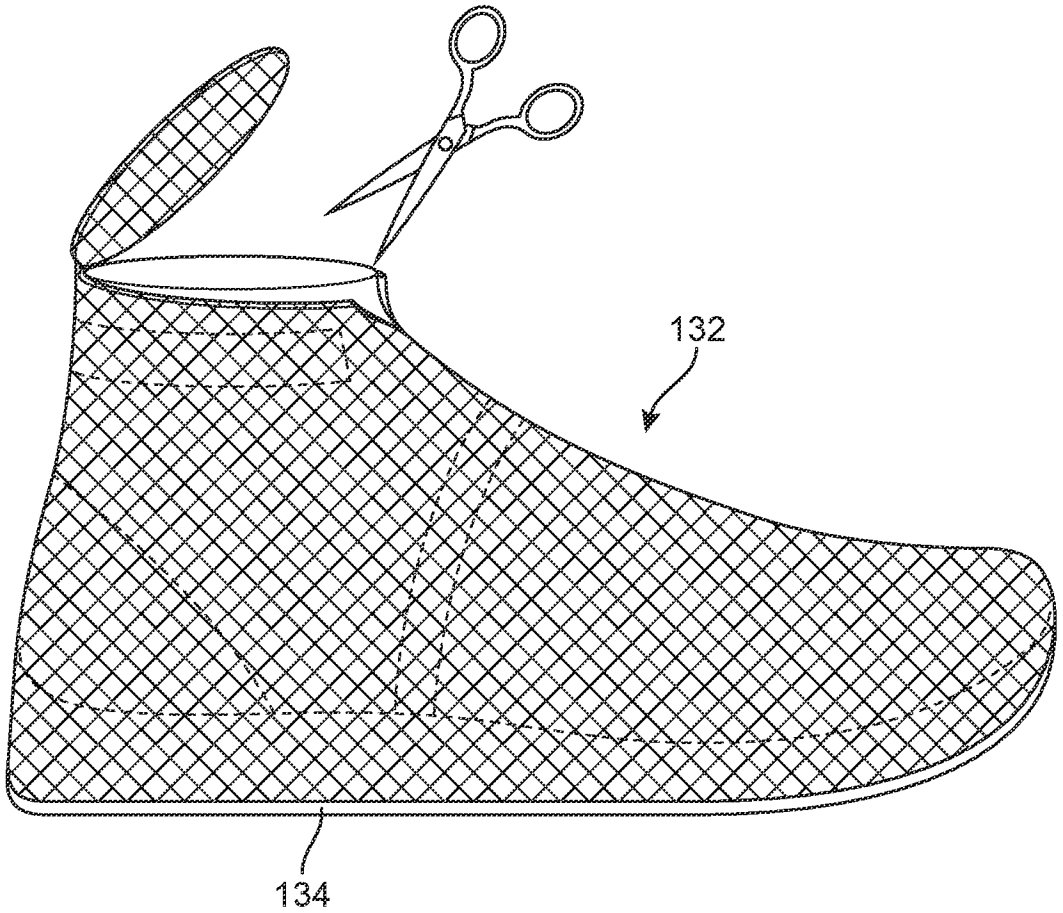
FIG. 16 is a schematic view of an embodiment of an upper braid assembly subjected to post processing.
Figure 17:
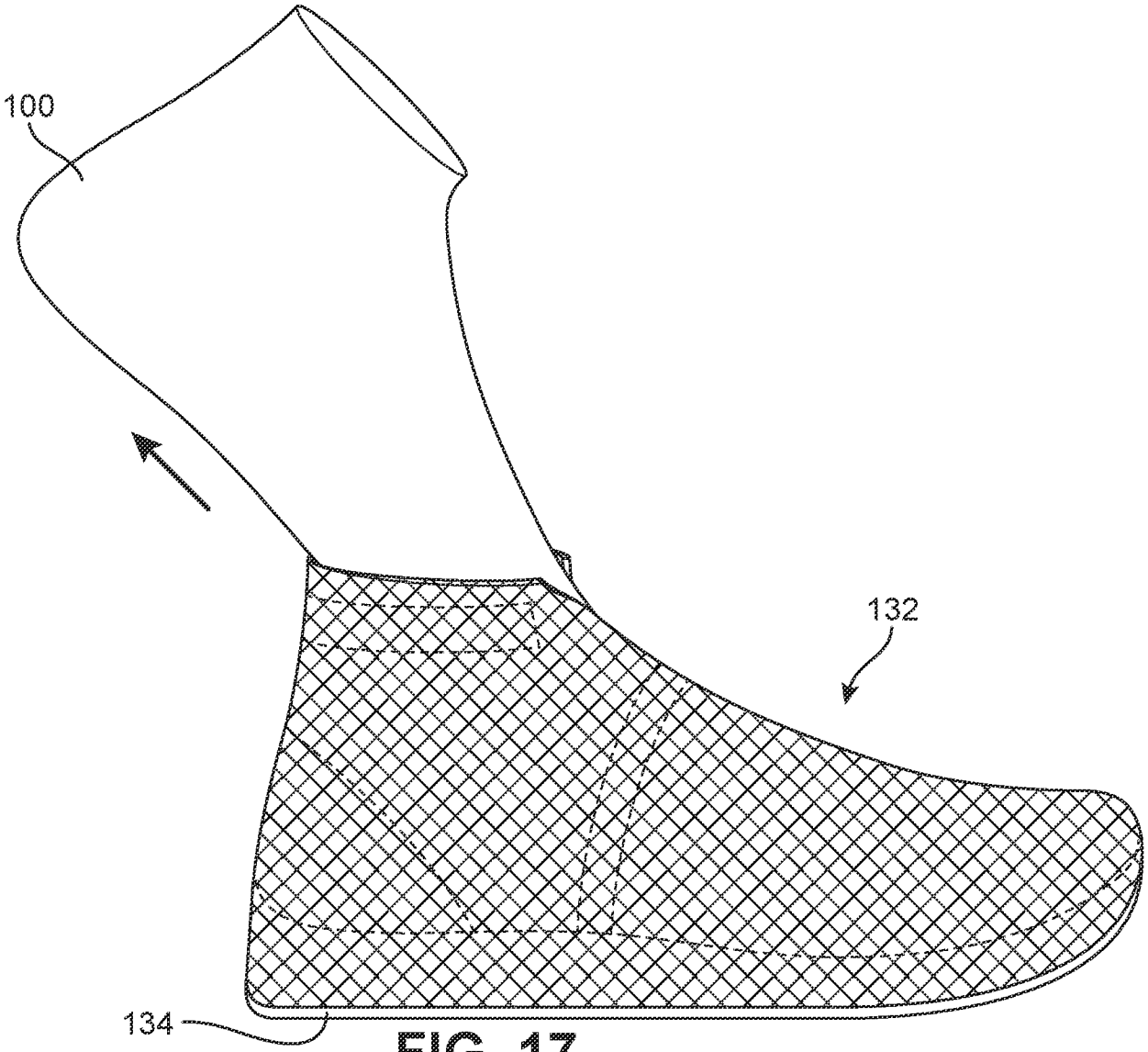
FIG. 17 is a schematic view of an embodiment of the last being removed from the upper braid assembly.

As shown in FIG. 16, additional alterations may be performed on upper braid assembly 132. In some embodiments, a portion of the braided structures may be removed. In some embodiments, the braided structure may be cut away using shears, a knife, laser, or other method. As shown in FIG. 17, once the braided structure has been removed, last 100 may be removed from upper braid assembly 132. Further post processing such as formation of eyelets, attachment of a tongue, and other alterations or additions may be performed to complete the article of footwear.

Figure 18:
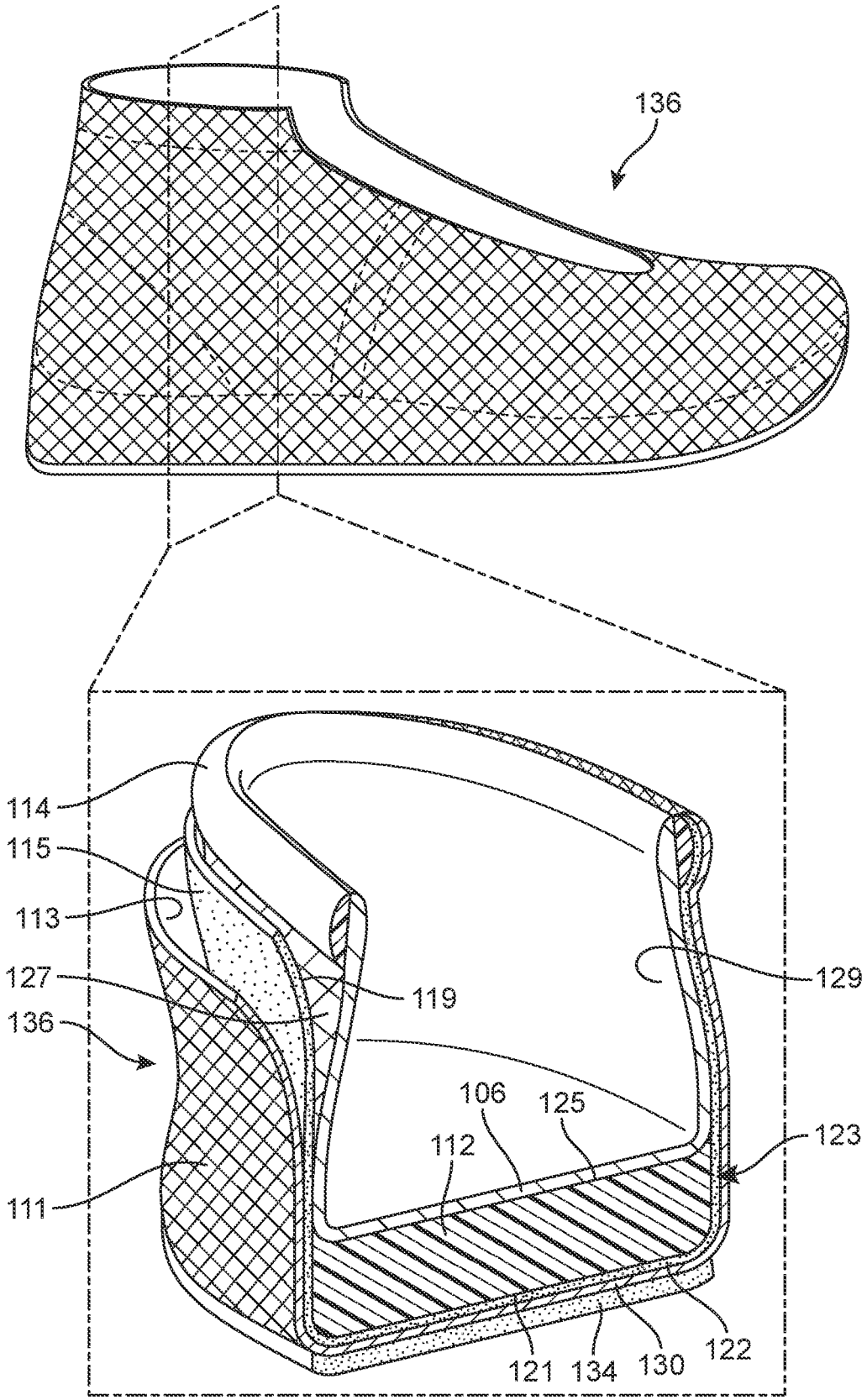
FIG. 18 is a schematic view of an embodiment of an article of footwear incorporating multiple braided layers.

Referring now to FIG. 18, article of footwear 136 or simply article 136 is depicted along with the cross section of article 136. The various layers of article 136 are clearly depicted in the cross section of article 136. As shown, outsole 134 is located adjacent to the ground surface and outsole 134 is also adjacent to a portion of outer surface 111 of second braided layer 130. The upper surface of outsole 134 is substantially covered by second braided layer 130, while the side surfaces and the lower surface of outsole 134 remain free of second braided layer 130. Second braided layer 130 is adjacent to adhesion layer 122. Adhesion layer 122 follows a substantially similar path as second braided layer 130 such that outer surface 115 of adhesion layer 122 contacts inner surface 113 of second braided layer 130. An opposite inner surface 119 of adhesion layer 122 extends along lower surface 121 of midsole 112 as well as along side surfaces 123 of midsole 112. Therefore, outer surface 115 of adhesion layer 122 contacts the inner surface 113 of second braided layer 130 and a second opposite surface, inner surface 119 of adhesion layer 122, contacts lower surface 121 of midsole 112 as well as side surfaces 123 of midsole 112. In the embodiment as shown, inner surface 113 of second braided layer 130 and outer surface 115 of adhesion layer 122 coextend along the surfaces or surface area of each other. That is, inner surface 113 of second braided layer 130 may be coextensive with outer surface 115 of adhesion layer 122. In some embodiments, however, adhesion layer 122 may not be present. In such embodiments, inner surface 113 of second braided layer 130 contacts lower surface 121 of midsole 112 as well as side surfaces 123 of midsole 112. Additionally, in such embodiments, outer surface 111 of second braided layer 130 contacts the upper surface of outsole 134. A second opposite surface, inner surface 113 of second braided layer 130, contacts lower surface 121 of midsole 112 as side surfaces 123 of midsole 112. In still further embodiments, adhesion layer 122 may be melted during manufacturing such that a precise layer is not discernible.

First braided layer 106 extends along upper surface 125 of midsole 112. Additionally, first braided layer 106 and adhesion layer 122 are adjacent to one another in an area vertically above or spaced from midsole 112. That is, in the location between the upper surface of midsole 112 and the upper bounds of article 136, first braided layer 106 and adhesion layer 122 are generally located adjacent to one another in embodiments that include an adhesion layer. For example, outer surface 127 of first braided layer 106 contacts inner surface 119 of adhesion layer 122. In other embodiments, first braided layer 106 may be adjacent to second braided layer 130 in a location between the upper surface of midsole 112 and the upper bounds of article 136. For example, outer surface 127 of first braided layer 106 may contact inner surface 113 of second braided layer 130 along the surface area of second braided layer 130. That is, outer surface 127 of first braided layer 106 may be coextensive with inner surface 113 and second braided layer 130. In still further embodiments, adhesion layer 122 may melt such that adhesion layer 122 is located within both first braided layer 106 and second braided layer 130 of article 136 in locations in which first braided layer 106 and second braided layer 130 are positioned adjacent to adhesion layer 122. In still further embodiments, outer surface 127 of first braided layer 106 may be coextensive with inner surface 119 of adhesion layer 122.

First braided layer 106 is located toward the interior of article 136, and second braided layer 130 is located along the exterior of article 136. For example, inner surface 129 of first braided layer 106 may face an interior of article 136 while outer surface 111 of second braided layer 130 is located along an exterior of article 136. Further, collar cushion 114 is encapsulated or surrounded by both first braided layer 106 as well as second braided layer 130. That is, in some embodiments, first braided layer 106 and second braided layer 130 or adhesion layer 122 may be separated by components that were previously attached to first braided layer 106. Collar cushion 114, support structure 116, as well as heel counter 118 may be secured in place by the combination of first braided layer 106 and second braid layer 130 as well as in combination with adhesion layer 122 in some embodiments. That is, collar cushion 114, support structure 116, and heel counter 118 are sandwiched between first braided layer 106 and second braided layer 130 and adhesion layer 122 in some embodiments.

The combination of layers may provide comfort to the foot of a user along the interior surface of article 136 while also providing a sturdy and durable outer surface of article 136. Additionally, by utilizing a braiding process, the amount of time required to form article 136 may be reduced when compared to articles that do not incorporate a braiding process. Further, by incorporating an adhesion layer or incorporating bondable strands into the braided layers of article 136, the quantity of time required to assemble article 136 may be reduced when compared to articles that do not incorporate a bonding mechanism as discussed in this detailed description. The adhesion layer or bondable strands may reduce the time required because a person may not be required to administer glue or other adhesive; rather, the bondable material is already incorporated into a separate layer or within the interior and exterior layers. Further, the process described may reduce the number of seams within article 136 when compared to other articles that do not incorporate a braiding process. Further, surrounding midsole 112 with second braided layer 130 may protect midsole 112 from damage by external forces or objects. Additionally, the positioning of first braided layer 106 and second braided layer 130 around midsole 112 may increase responsiveness when compared to other articles. Due to the proximity of second braided layer 130 to the ground during use and because second braided layer 130 passes below midsole 112 and is also attached to first braided layer 106, a user may sense or feel external force quickly. The encapsulated midsole 112 may experience less shear force along the junction between midsole 112 and first braided layer 106 than in other embodiments that do not include a second braided layer 130. Further, because midsole 112 is encapsulated by first braided layer 106 and second braided layer 130, the amount of adhesive required to secure midsole 112 to article 136 may be reduced when compared with other embodiments.

Figure 19:
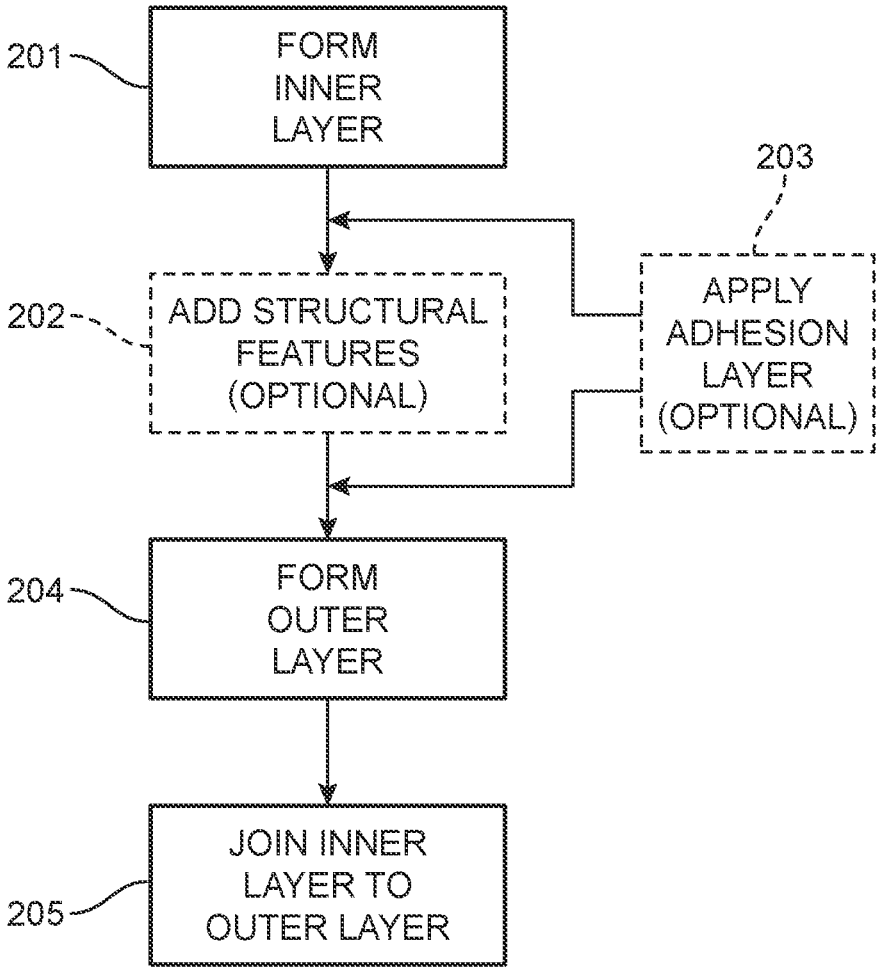
FIG. 19 is a schematic view of an embodiment of a method for forming an article of footwear incorporating braided layers.
Figure 20:
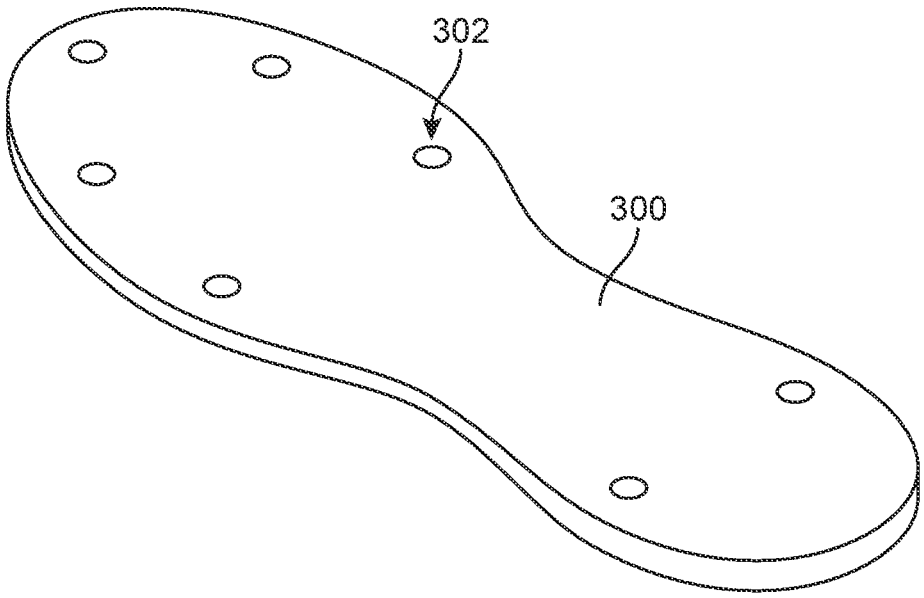
FIG. 20 is a schematic view of an alternate embodiment of a plate used in an article of footwear.

Referring now to FIG. 19, the process for forming an article is depicted. In step 201, an interior layer is formed. As depicted in FIGS. 2-4 of the embodiment described previously, the interior layer may be similar to first braided layer 106. Other embodiments may include other materials that are formed using different techniques other that braiding. In step 202, structural features are optionally added. As described with reference to FIGS. 5 and 6, some examples of structure features include heel counters, midsoles, toe caps, and various types of cushioning. In optional step 203, an adhesion layer is applied. The adhesion layer may be applied at various and multiple times during manufacturing, depending on the desired outcome. For example, step 203 may be performed before step 202 or not at all. In step 204, an outer layer is applied over the combined interior layer and the optional structural features and/or adhesion layer. An example of an outer layer is second braided layer 130 as described in this detailed description. In step 205, the inner layer and outer layer are joined. Joining may be achieved by heat, spot welding, or other activation mechanism. In the embodiment previously described, heat was used to combine first braided layer 106 with second braided layer 130. After step 205 additional post processing may be performed to complete an article of footwear.

It may be appreciated that in at least some embodiments, the inner layer and the outer layer of an article could be made of dissimilar materials. For example, in some embodiments, the inner layer may not be a braided layer, but could be a nonwoven layer, polymer layer or other layer, while the outer or exterior layer could be a braided layer.

Article Incorporating Plate

An alternate embodiment of an article incorporating multiple braided layers is depicted in FIGS. 20-28. In some embodiments, an article may incorporate a rigid plate. As shown in FIG. 19, plate 300 includes plurality of apertures 302. Plurality of apertures 302 may be through holes or blind holes. Additionally, plurality of apertures 302 may include female threaded portions for accepting male threaded portions. Further, plurality of apertures 302 may be configured to accept other fittings. For example, plurality of apertures 302 may be configured to accept pressure-fitted components.

Plurality of apertures 302 are particularly arranged to assist in providing traction to an article of footwear that incorporates plate 300. Plurality of apertures 302 may be arranged in a different configuration with more apertures or less apertures than depicted in FIG. 20. Plate 300 may be formed from a rigid material such as carbon fiber, hardened plastic, metal, or other rigid material. Further, in some embodiments, plate 300 may be formed of a resilient material such as foam or thermoplastic. As depicted, plate 300 is formed of a rigid material with sufficient strength to support a stud, cleat, or other ground-engaging member. Plate 300 is shown as substantially planar and has substantially the same thickness along the length of plate 300. In other embodiments, the thickness of plate 300 may vary along the length of plate 300. Generally, plate 300 may be used in conjunction with soccer boots or football boots among other types of articles of footwear.

Figure 21:
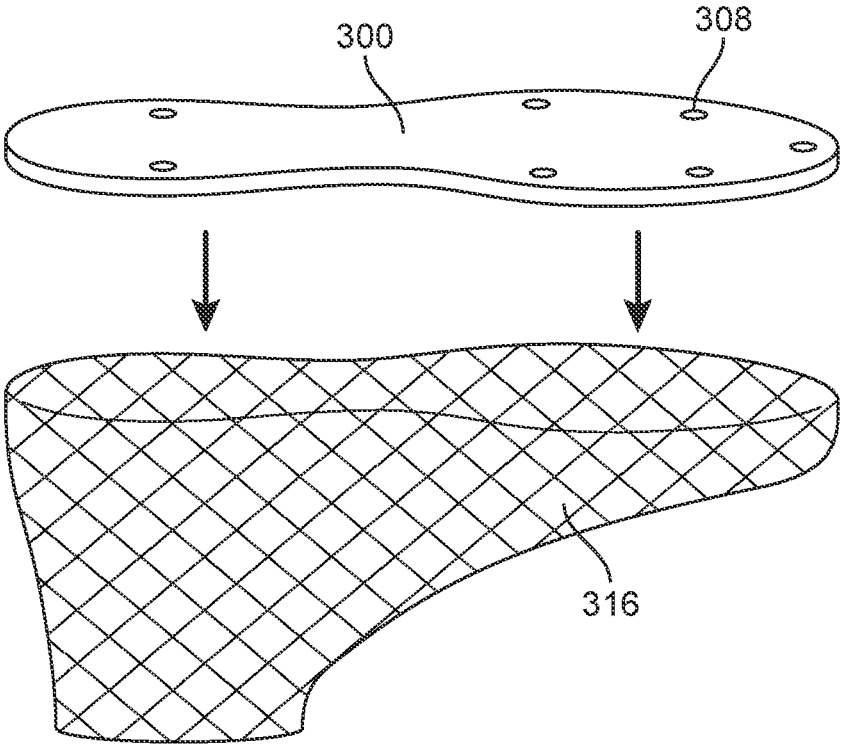
FIG. 21 is a schematic view of an embodiment of a braided component and a plate.
Figure 22:
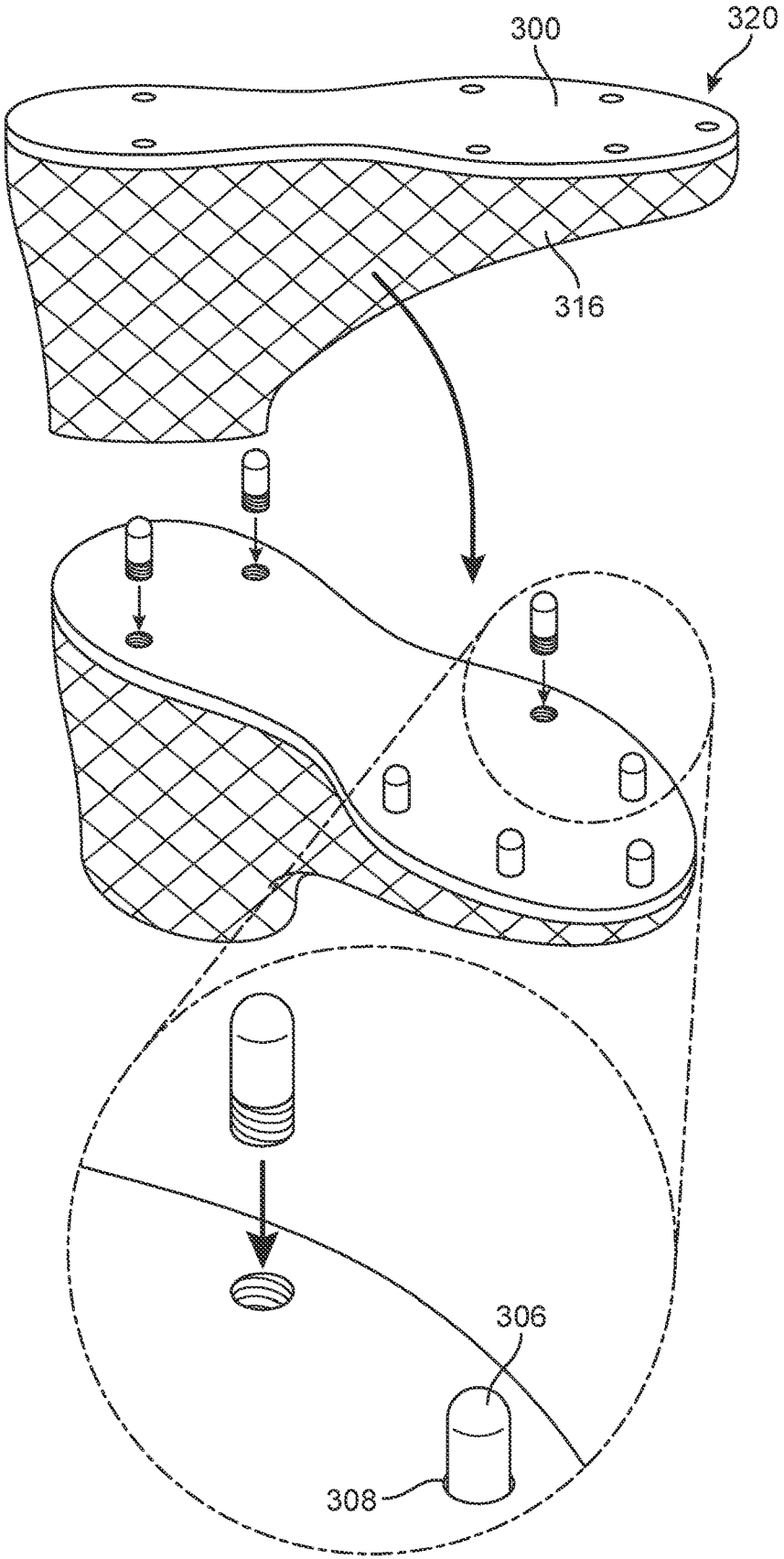
FIG. 22 is a schematic view of an embodiment of a deflector being inserted into a plate.

As shown in FIGS. 21 and 22, plate 300 is attached to first braided layer 316 and forms interior braid assembly 320. The manufacturing process as shown in FIG. 21 is at second step 202 as previously shown in FIG. 19. First braided layer 316 may overbraid a last and then components may be attached to first braided layer 316. Additionally, the material used to form first braided layer 316 may be similar to the material used to form first braided layer 106 as described in a previous embodiment. Further, in some embodiments, the layer placed over the last may have various configurations such as knit, woven, or non-woven configurations. Plate 300 may be attached to first braided layer 316 by glue, TPU bonding, mechanical fasteners, or other technique or method.

In some embodiments, a component or object may be utilized to change the direction of the strands as the strands are overbraided around interior braid assembly 320. In some embodiments, an object may be inserted into plurality of apertures 302. The object may prevent the apertures of plurality of apertures 302 of plate 300 from being overbraided during a braiding process. In some embodiments, plurality of deflectors 304 may be inserted into plurality of apertures 302 of plate 300. Plurality of deflectors 304 may be formed of plastic or metal or a different material. The surface of plurality of deflectors 304 may be smooth so as to assist in deflecting strands away from the deflectors.

In some embodiments, plurality of deflectors 304 may include provisions to assist in securing plurality of deflectors 304 to plate 300. In some embodiments, plurality of deflectors 304 may be removably secured to plate 300. That is, plurality of deflectors may be easily and reusably attached and removed from plate 300. For example, plurality of deflectors 304 include threaded portions so that plurality of deflectors 304 may be inserted into plurality of apertures 302 of plate 300. Plurality of deflectors 304 may then be tightened into place in plurality of apertures 302. After the braiding process, plurality of deflectors 304 may be removed from plate 300 and used in another plate for use in another article of footwear.

Plurality of deflectors 304 may be particularly shaped to urge the strands from a braiding machine to pass along side each of the deflectors rather than cover the deflectors. Generally, each deflector gains width and slopes away from the tip of the deflectors. Referring specifically to deflector 306, deflector 306 is inserted within aperture 308. As shown, deflector 306 includes a convex curved upper portion. The curved upper portion may be spherical or oblong in shape. In other embodiments, the upper portion may be pyramidal or trapezoidal. Additionally, deflector 306 is rounded in shape to minimize instances of the strand being cut or caught by deflector 306.

Figure 23:
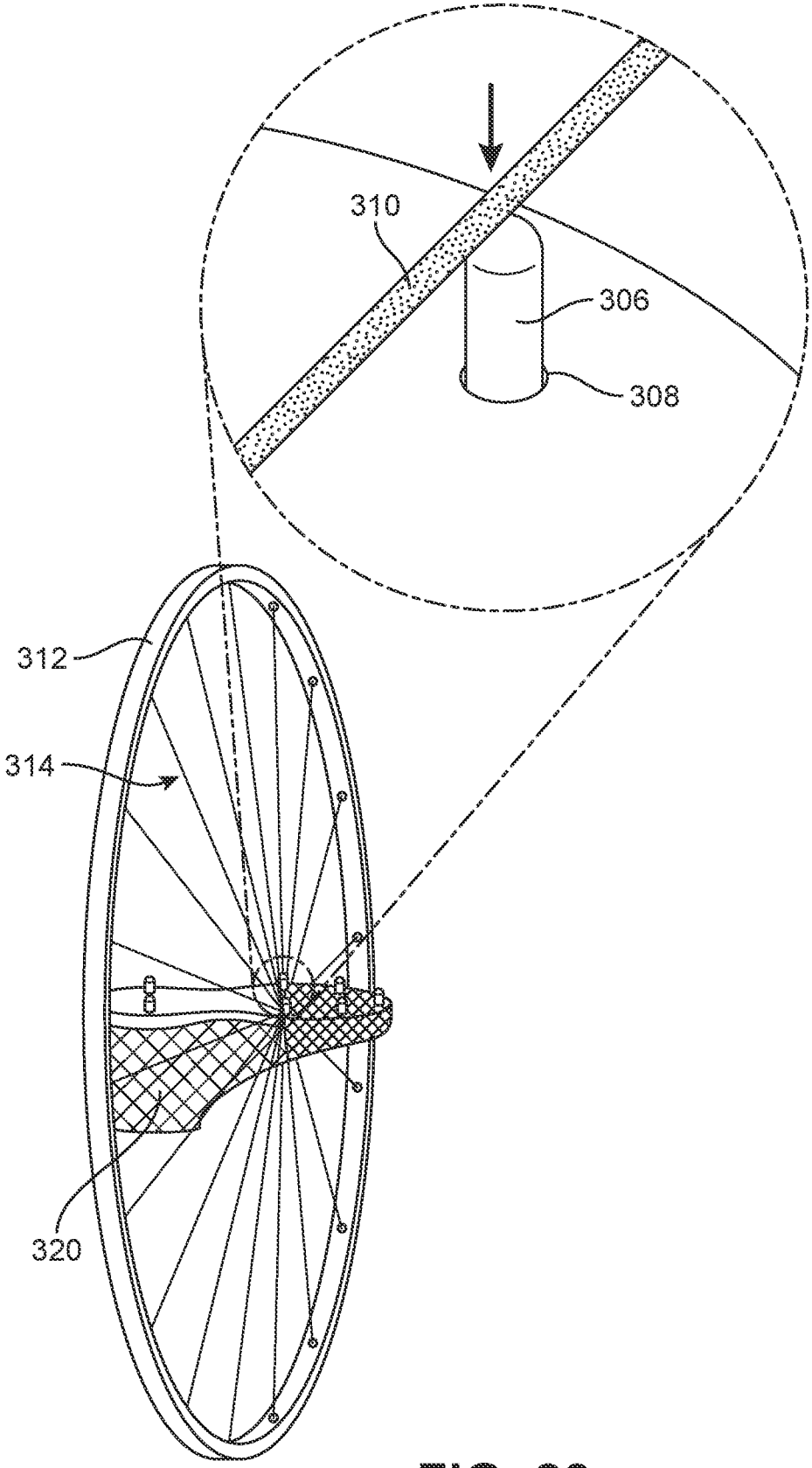
FIG. 23 is a schematic view of an embodiment of a strand contacting a deflector.
Figure 24:
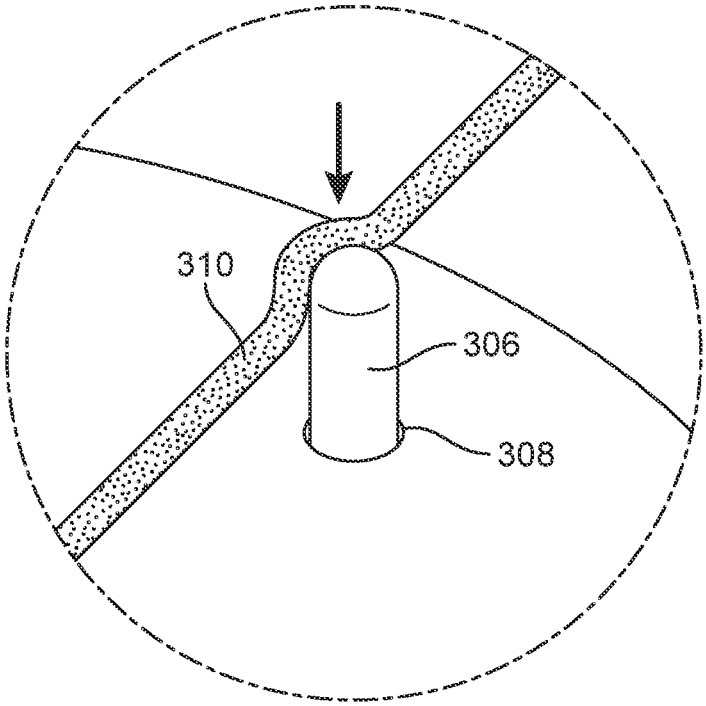
FIG. 24 is a schematic view of an embodiment of a strand contacting a deflector.
Figure 25:
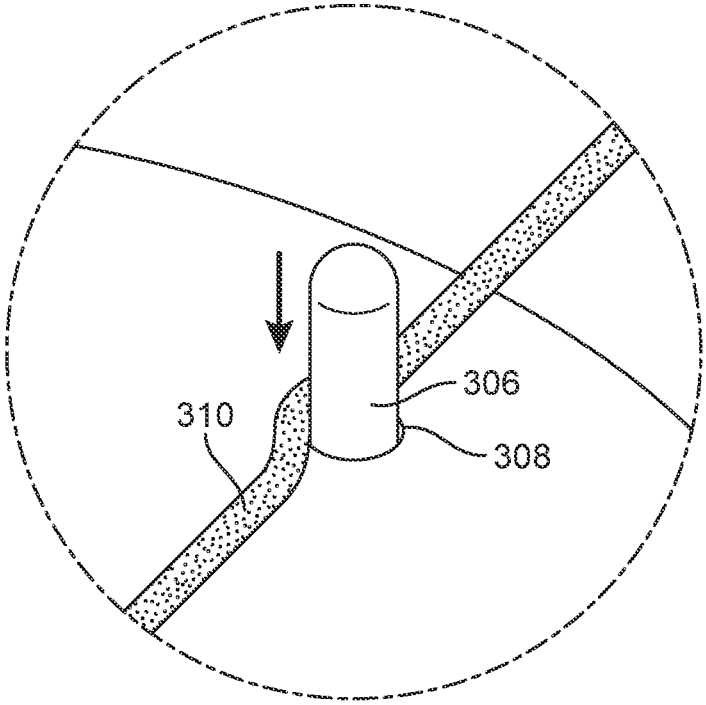
FIG. 25 is a schematic view of an embodiment of a strand contacting a deflector.

Referring now to FIGS. 23-25, deflector 306 is depicted during a moment of the braiding process. This step of the manufacturing process is the same as step 204 as shown in FIG. 19. Interior braid assembly 320 passes partially through braiding machine 312 as plurality of strands 314 are deposited along the surface of interior braid assembly 320. Plurality of strands 314 may have different properties than the strands used to form first braided layer 316. For example, plurality of strands 314 may be abrasion resistant. The enlarged view of FIG. 23 depicts strand 310 contacting the curved surface of deflector 306. As shown in FIGS. 24 and 25, strand 310 is urged along the side of deflector 306 by the convex upper portion of deflector 306. Strand 310 is pushed to the side of deflector 306 such that strand 310 is adjacent to plate 300. By pushing or deflecting strand 310 around deflector 306, aperture 308 may be clear from strands when a ground-engaging member is inserted into aperture 308.

Figure 26:
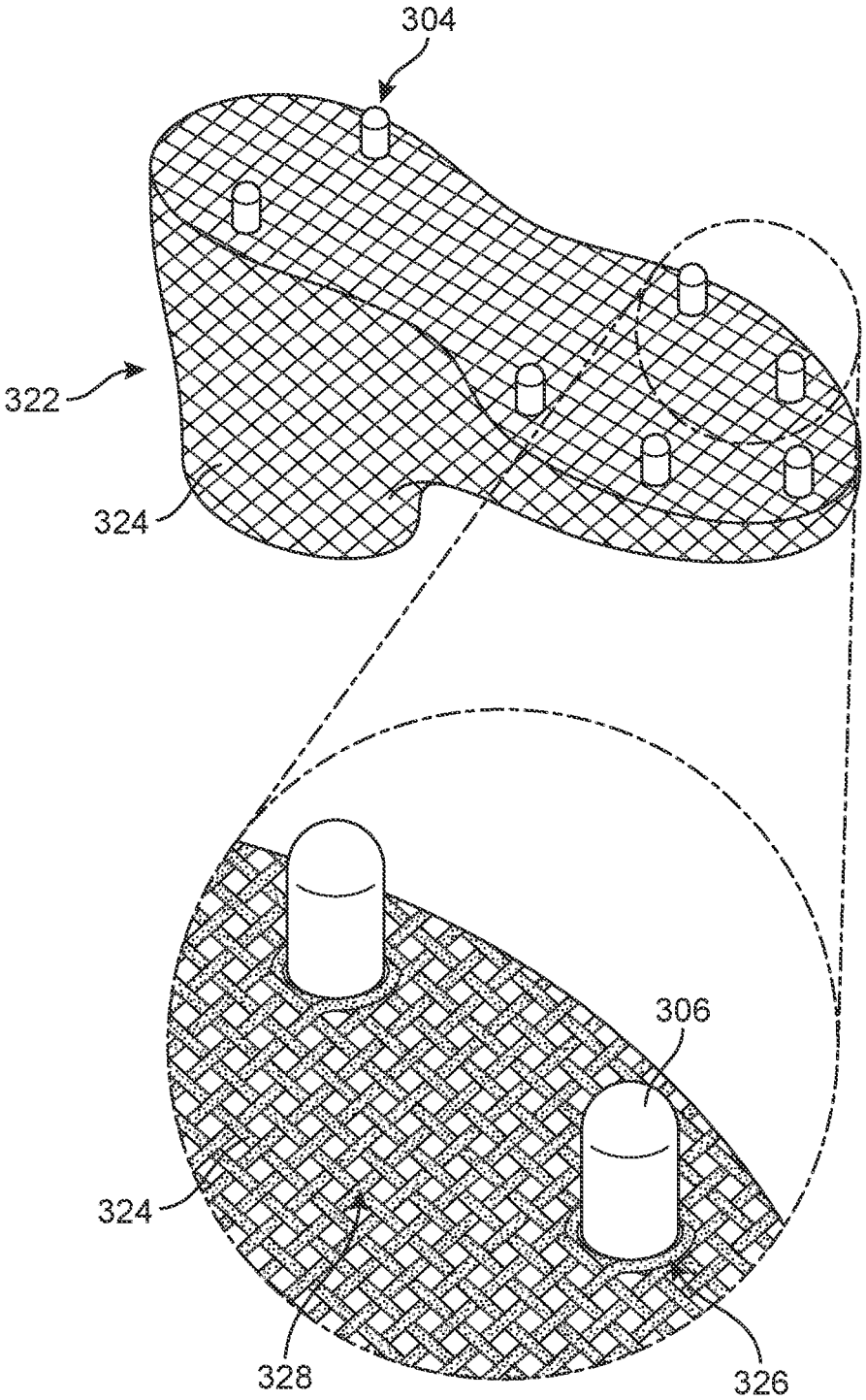
FIG. 26 is a schematic view of an embodiment of a braided component and a deflector.

Referring to FIG. 26, the underside of article 322 is depicted. Article 322 has been removed from braiding machine 312. As shown, second braided layer 324 is applied along the outer surface of interior braid assembly 320. In some embodiments, first braided layer 316 and second braided layer 324 may be joined prior to removal of plurality of deflectors 304. In other embodiments, first braided layer 316 and second braided layer 324 may be joined after removal of plurality of deflectors 304. Although not depicted, an adhesion layer may be utilized during the manufacturing process of article 322. As discussed with reference to the previous embodiment, in some embodiments, first braided layer 316 and second braided layer 324 may include thermoplastic strands or other bondable strands. First braided layer 316 and second braided layer 324 may then be joined using heat, spot welding, lasers, or other mechanisms. For purposes of this embodiment, first braided layer 316 and second braided layer 324 are bonded to each other as depicted in FIG. 26.

As shown in FIG. 26, strands of second braided layer 324 may be condensed adjacent to the deflectors. Because deflector 306 occupies the space that strands would normally overbraid, the areas adjacent to deflector 306 may have a greater density of strands than in areas that are not adjacent to deflectors. For example, area 326 adjacent to deflector 306 may have a greater density of strands than does area 328 that is spaced from deflector 306. The density of the strands of a braided structure, however, may be adjusted by changing the speed at which the last is passed through the braiding machine as well as the speed at which the spools rotate around the braiding machine.

Figure 27:
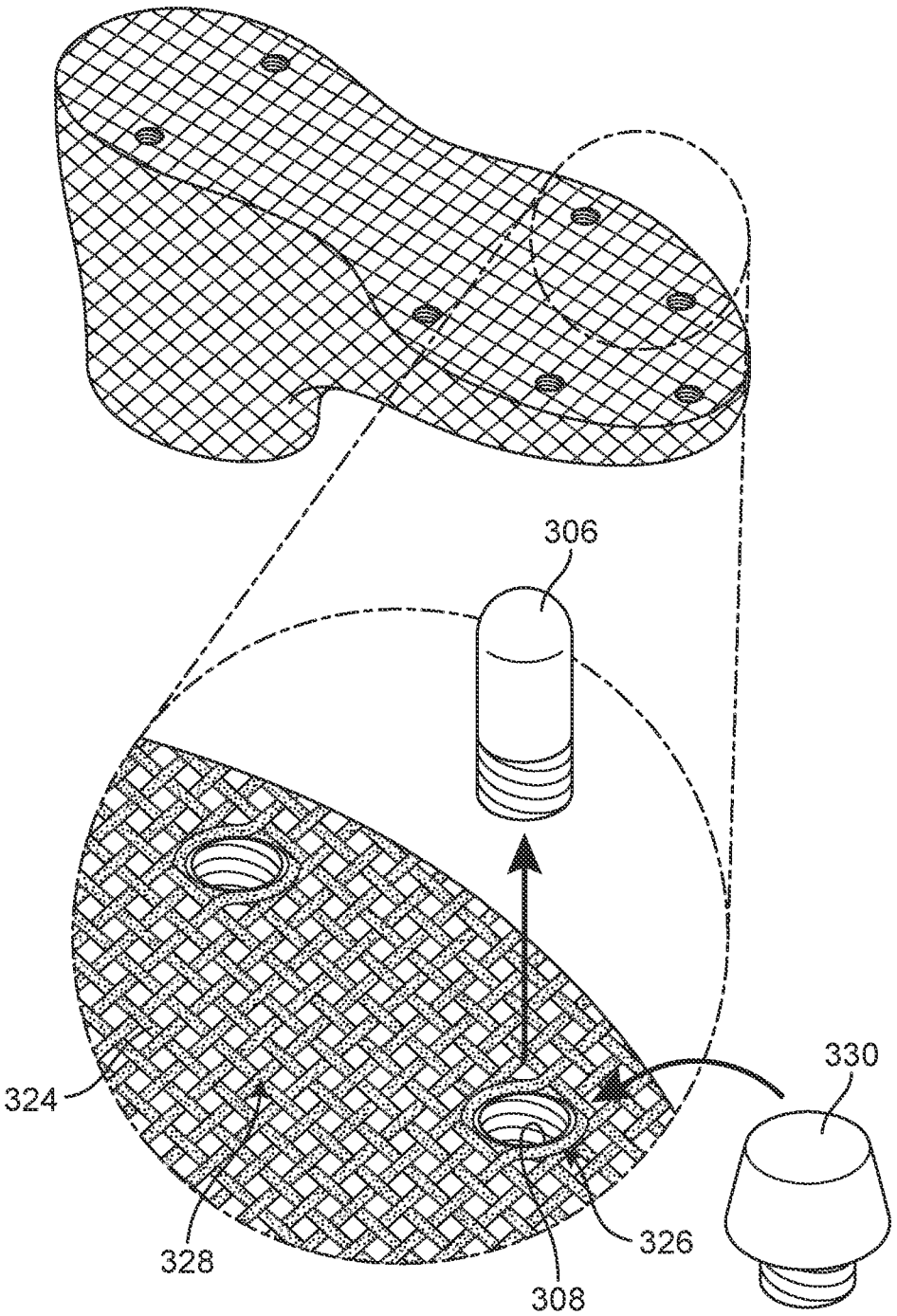
FIG. 27 is a schematic view of an embodiment of a deflector being removed from a plate.
Figure 28:
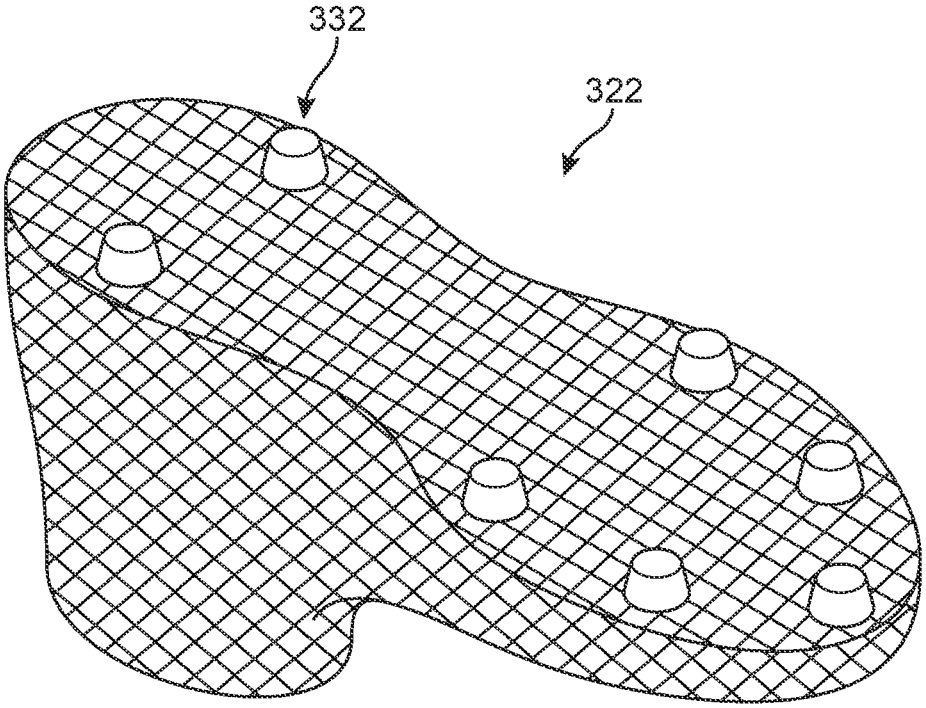
FIG. 28 is a schematic view of an embodiment of an article of footwear incorporating ground-engaging members.

Referring now to FIGS. 27 and 28, deflector 306 is removed from aperture 308. Because second braided layer 324 has been secured in place, the strands of second braided layer 324 may remain stationary such that the strands do not cover aperture 308 even after deflector 306 is removed. Further, second braided layer 324 covers substantially all the lower surface of plate 300 except for plurality of apertures 302. Because aperture 308 remains uncovered, ground engaging member 330 may be inserted into aperture 308. Ground engaging member 330 may include a threaded end such that ground engaging member 330 is removable. In other embodiments, ground engaging member 330 may be permanently secured using adhesives or other bonding material. In still further embodiments, ground engaging member 330 may be secured using a pressure or friction fit. Likewise, the other apertures of plurality of apertures 302 may be fitted with plurality of ground engaging members 332. Although shown as studs, it should be recognized that various shapes and sizes of ground-engaging members such as cleats may be utilized. Additionally, plurality of ground engaging members 332 may include pointed or angled surfaces. Due to the sharp nature of these surfaces, plurality of deflectors 304 may be utilized to move the strands during the braiding process rather than utilizing plurality of ground engaging members 332 during the braiding process.

In some embodiments, a plurality of deflectors is not utilized during the braiding process. In some embodiments, plate 300 is overbraided with second braided layer 324 such that plurality of apertures 302 are also covered by second braided layer 324. After braiding is complete, plurality of ground engaging members 332 may be pressed through second braided layer 324. In some embodiments, second braiding layer 324 may be punctured or cut to provide space through which plurality of ground engaging members 332 may pass to allow plurality of ground engaging members 332 to be inserted into plurality of apertures 302.

In some embodiments, plurality of ground engaging members 332 may have different cross-sectional areas than plurality of deflectors 304. As shown, ground engaging member 330 has a larger or wider portion above the threaded portion of ground-engaging member than the head portion of deflector 306. When secured into aperture 308, a portion of ground engaging member 330 may contact second braided layer 324. Therefore, a portion of second braided layer 324 may be sandwiched between ground engaging member 330 and plate 300. In other embodiments, ground engaging member 330 passes through second braided layer 324 and into plate 300; however, ground engaging member 330 does not pinch or sandwich a portion of second braided layer 324. In contrast to article 136, article 322 may not include an outsole. Rather, second braided layer 324 may function as an outsole.

The location of the layers of article 322 may be substantially similar to the location of the layers of article 136. Article 322 includes plurality of ground engaging members 332 that are configured to contact a ground surface. A portion of plurality of ground engaging members 332 is located vertically below second braided layer 324 and a portion of plurality of ground engaging members 332 is located vertically above second braided layer 324. Second braided layer 324 is located between a lower portion of plurality of ground engaging members 332 and plate 300. Second braided layer 324 contacts the lower surface of plate 300 and also contacts the side surfaces of plate 300. Further, second braided layer 324 remains visible and exposed along the lower surface of plate 300. First braided layer 316 contacts an upper surface of plate 300. In a location vertically above plate 300, second braided layer 324 contacts first braided layer 316. Other embodiments may include other components that are located between first braided layer 316 and second braided layer 324 such as a heel counter.

By forming article 322 in the manner as described above, the weight of article 322 may be reduced when compared to other articles that are not formed in the same manner. For example, in some embodiments, article 322 may not require an outsole or other protective covering. The absence of an outsole may reduce the weight and cost of production of article 322. Further, because plate 300 is sandwiched between at least two layers, the quantity of adhesive or other bonding agent used or required to secure plate 300 may be less than embodiments that do not incorporate the method as described. The quantity of time required to form an article using this method may be less than other methods. Because many steps may be done quickly and accurately, a greater number of articles may be formed using this method as opposed to other methods. Further, the method described above allows for greater automation than other embodiments that do not incorporate the method as described above. By increasing the number of steps that may be automated, the number of articles formed over a given time may be greater than embodiments that do not incorporate the method as described above.

Pleated Areas

Some articles of footwear may include high stress areas that are more likely to experience greater force during use than other areas of the article of footwear. For example, the toe box area of an article of footwear may be exposed to an increased level of force during a lateral cut by a user. This level of force may be greater than the level of force that a midfoot portion of the article is exposed to during the same motion by a user. Some embodiments may include portions of an upper formed to counteract the increased force by fortifying specific areas. By fortifying these areas, the article may resist stretching and also provide additional support to a user during use. In some embodiments, additional material may be incorporated into these specific areas. In some embodiments, for example, pleats may be formed in a braided structure. Incorporating additional material in a uniform and continuous manner may decrease the time necessary to form an article of footwear while also increasing the consistency and quality with which the article is formed.

Referring to FIGS. 29-34, last 400 is shown in conjunction with braiding machine 402. Braiding machine 402 may be similar in construction to braiding machine 102, braiding machine 126, and braiding machine 312. The strands that braiding machine 402 deposits around last 400 may be formed of material as discussed previously in this detailed description with reference to different embodiments.

Figure 29:
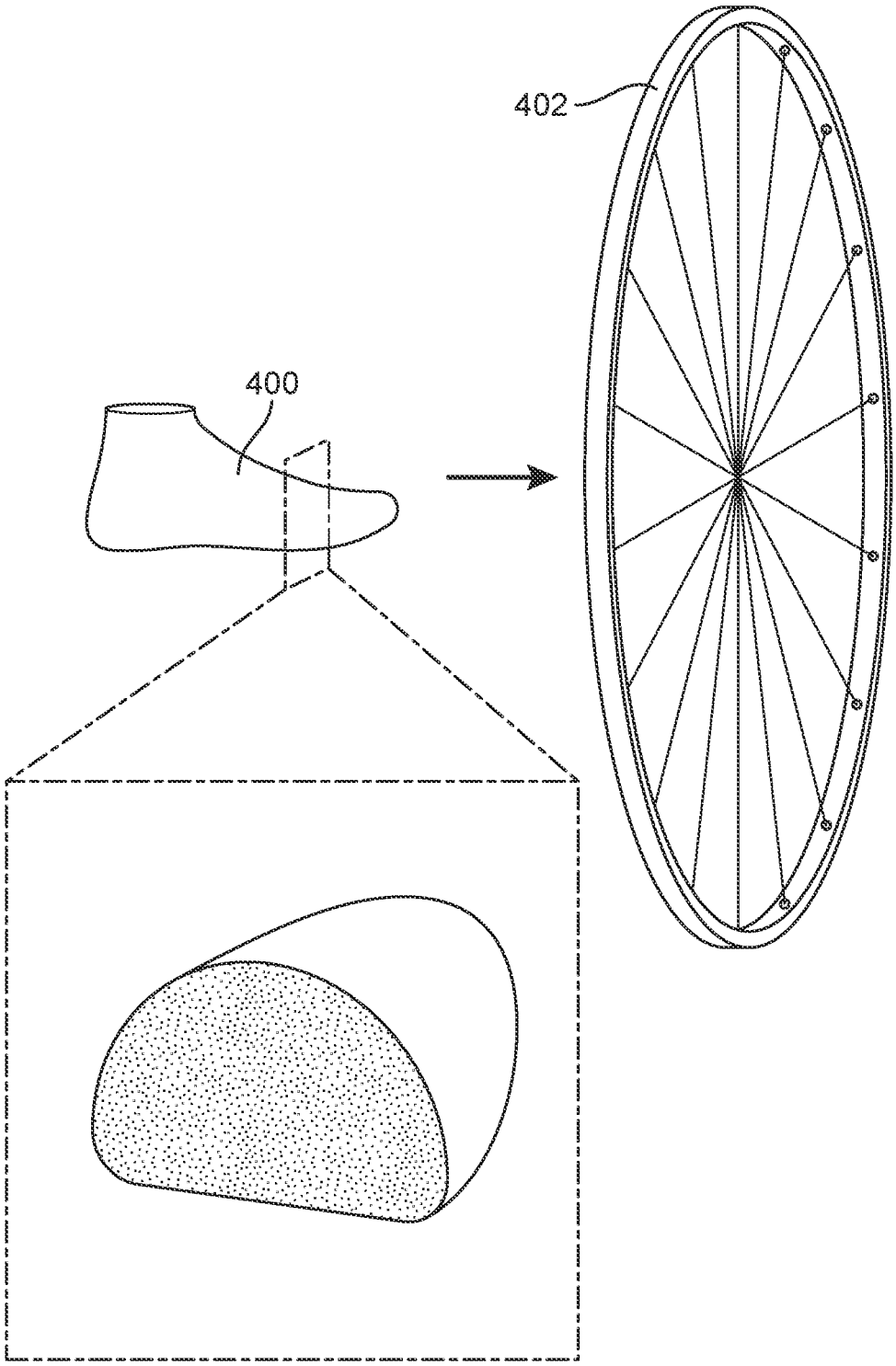
FIG. 29 is a schematic view of an embodiment of a last a braiding machine.
Figure 30:
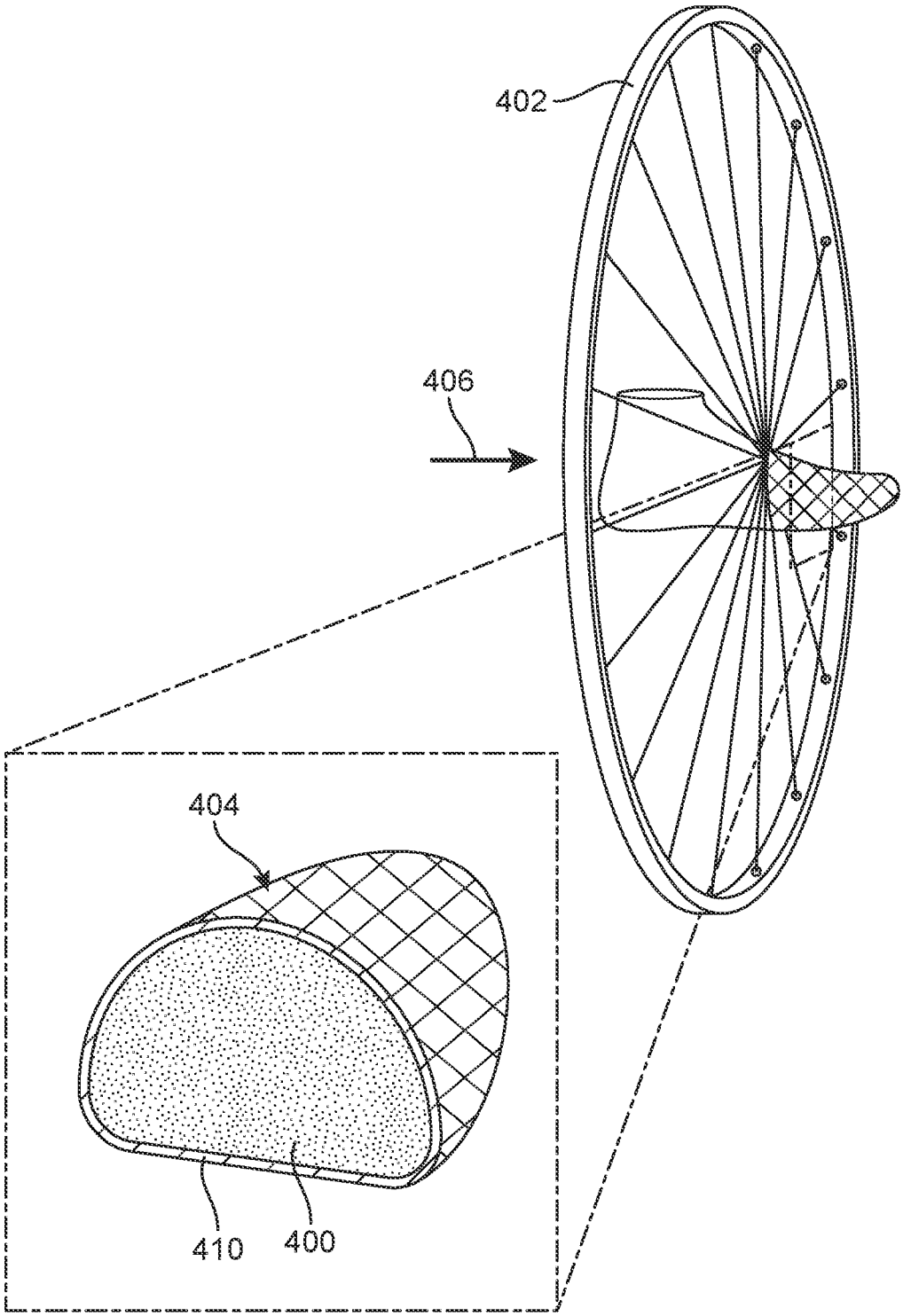
FIG. 30 is a schematic view of an embodiment of a last in a braiding machine.
Figure 31:
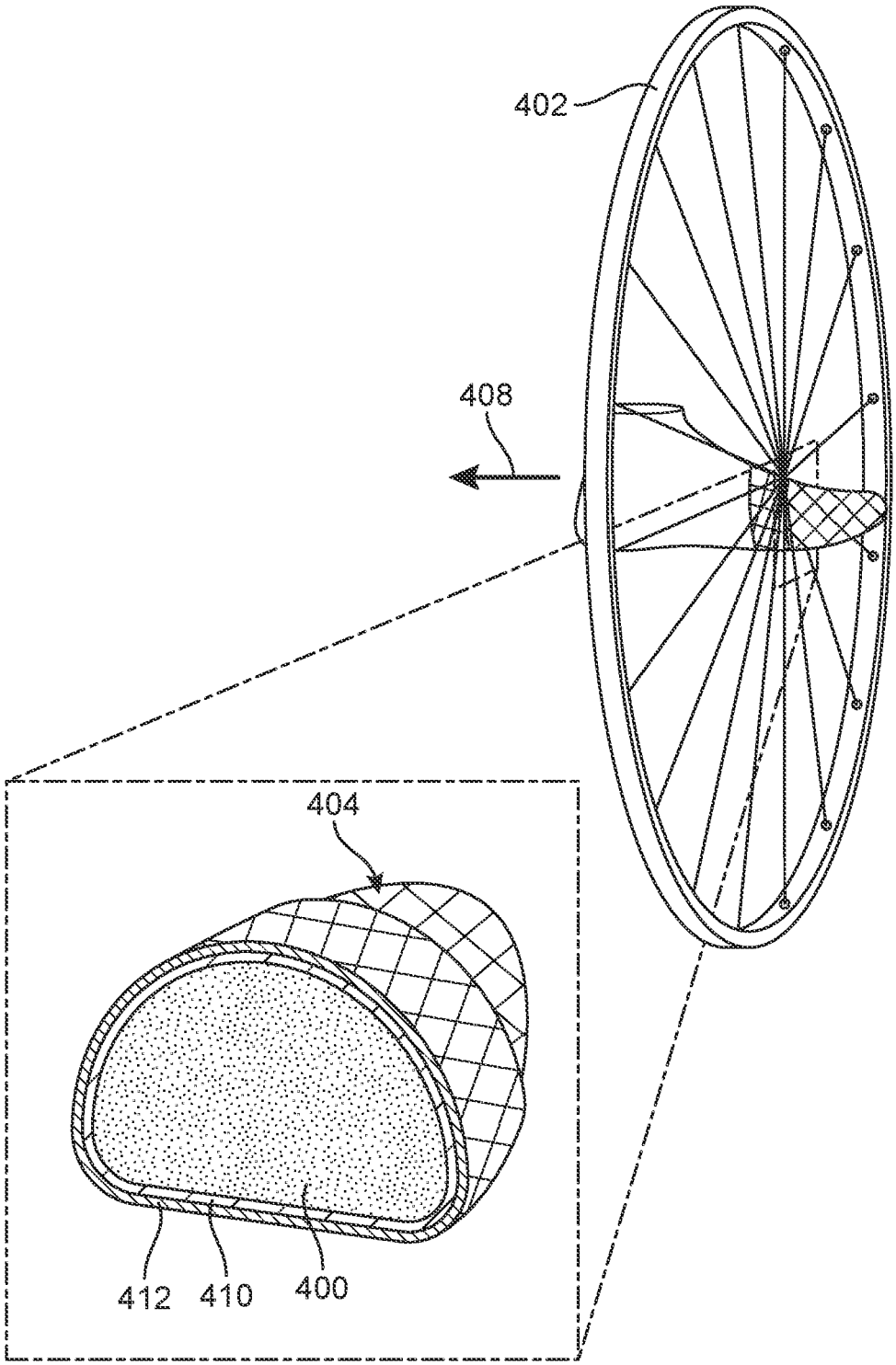
FIG. 31 is a schematic view of an embodiment of a last in a braiding machine.

In some embodiments, the direction in which a last or shaping object is moved or translated through the braiding point of a braiding machine may impact the geometry of the braided component that is deposited upon the last. Referring to FIGS. 29-31, last 400 is passed through braiding machine 402. As shown in each of the FIGS. 29-31, the cross section through last 400 is depicted. In FIG. 29, last 400 has yet to pass through braiding machine 402 and therefore no threads or strands have been deposited along the surface of last 400. In FIG. 30, last 400 has been moved forward in a first braiding direction along first direction arrow 406 through the braiding point of braiding machine 402 such that first braided layer 410 of braided component 404 is deposited along the surface of last 400. This is in a similar manner to the step as shown in FIG. 3.

Referring now to FIG. 31, the feeding direction in which last 400 is moved is reversed to move along the path of second direction arrow 408, which is an opposite direction from first direction arrow 406. As a result, second braided layer 412 is deposited on top of the previously braided layer, first braided layer 410. In the embodiment as shown, second braided layer 412 is formed in a continuous and unitary relationship with first braided layer 410 such that first braided layer 410 and second braided layer 412 are of a unitary braided construction. That is, braided component 404 includes both first braided layer 410 and second braided layer 412. First braided layer 410 and second braided layer 412 may be formed without removing last 400 from braiding machine 402. Additionally, the strands from first braided layer 410 extend continuously into second braided layer 412 without requiring second braided layer 412 to be adhered to first braided layer 410. This continuously formed second layer may be quickly and easily formed during the manufacturing process. Additionally, the movement of last 400 may cause a fold to form in braided component 404, thereby positioning first braided layer 410 adjacent to second braided layer 412.

Figure 32:
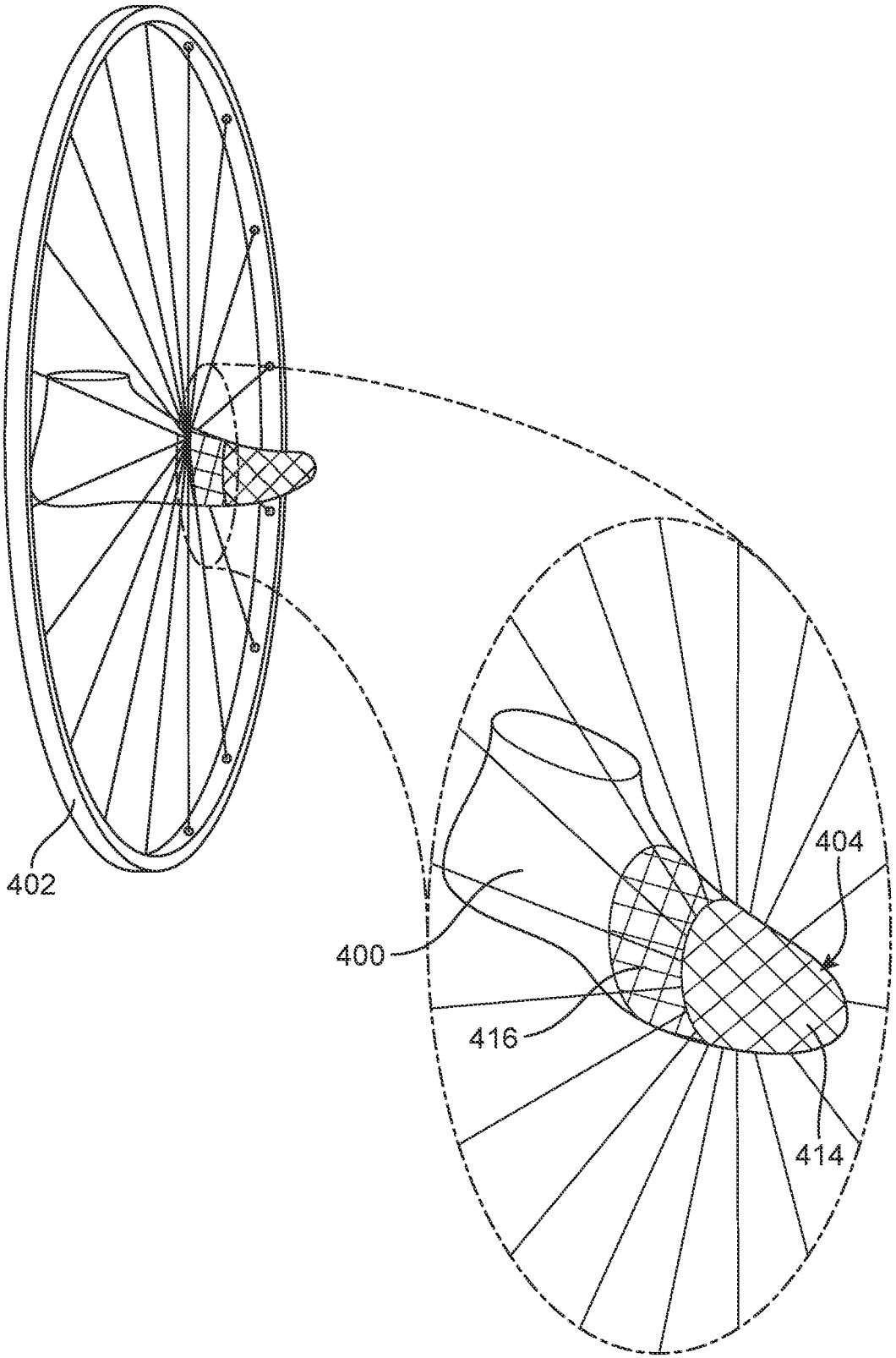
FIG. 32 is an isometric view of an embodiment of a last in a braiding machine.

Referring now to FIG. 32, an enlarged view of last 400 and braided component 404 surrounds last 400 is depicted. As shown, first area 414 or a first portion includes a single braided layer, for example, first braided layer 410. A portion of first area 414 is formed when last 400 is passed through the braiding point of braiding machine 402 along the feeding direction of first direction arrow 406. Second area 416 includes a double braided layer. For example, second area 416 includes first braided layer 410 and second braided layer 412. The distance that last 400 is passed from the braiding point determines the length of first area 414. Second area 416 or a second portion is formed when last 400 is passed through the braiding point along the feeding direction of second direction arrow 408. The width of second area 416 is determined based on the distance that last 400 is moved along the feeding direction of second direction arrow 408 with respect to the braiding point. As shown in FIG. 32, second area 416 is located on the opposite side of the braiding point from first area 414.

Figure 33:
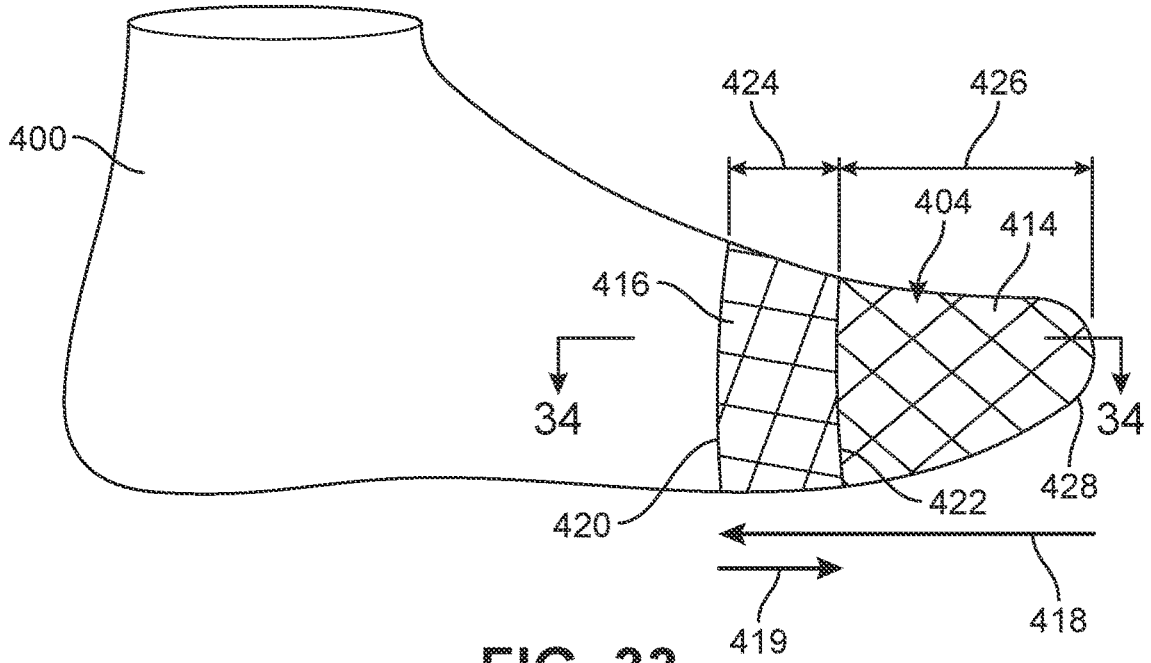
FIG. 33 is a schematic view of an embodiment of a braided component around a last.
Figure 34:
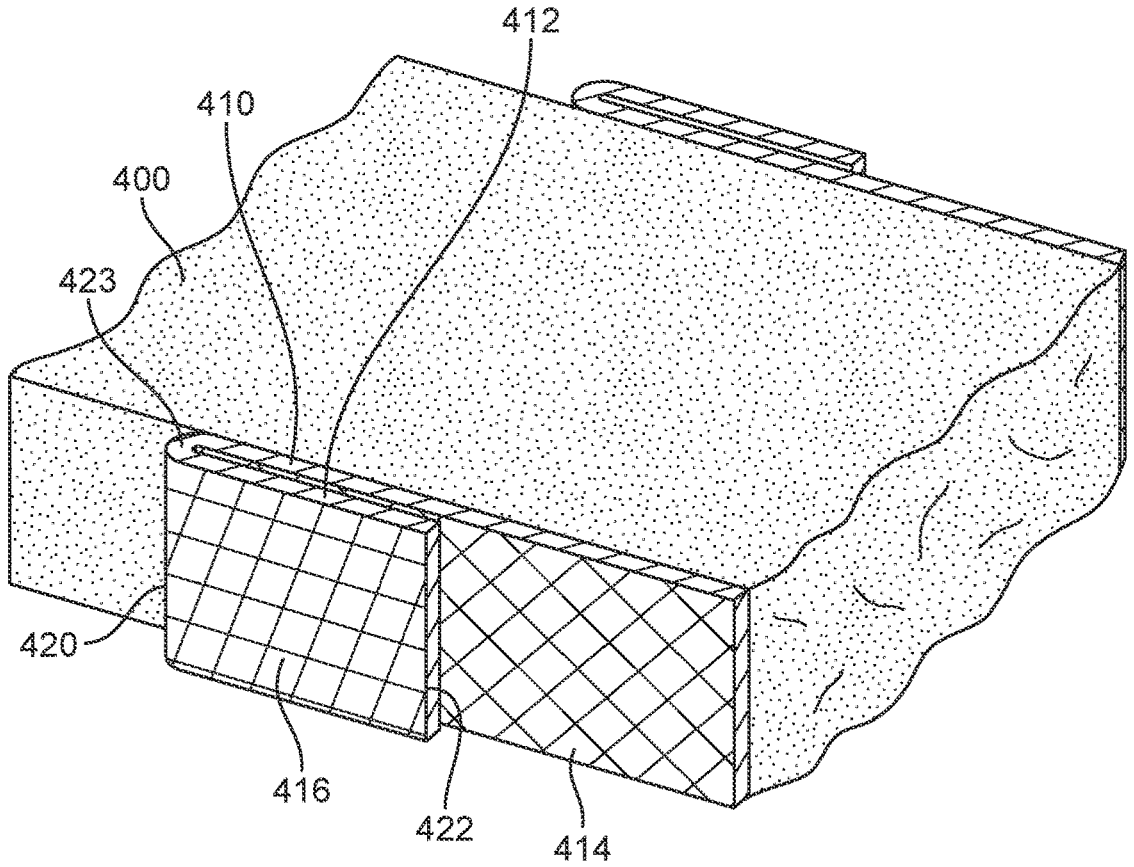
FIG. 34 is an isometric view of an embodiment of a portion of a braided component around a last.

Referring now to FIGS. 33 and 34, additional views of braided component 404 are depicted. Referring specifically to FIG. 33, a side view of last 400 along with first area 414 and second area 416 of braided component 404 is depicted. Additionally, the location of the braiding point during manufacturing with respect to the various areas is depicted. First arrow 418 depicts the initial motion of the braiding point. For example, first arrow 418 depicts the motion of the braiding point as last 400 moves from the location as depicted in FIG. 29 to the location as depicted in FIG. 30. The braiding point begins in the toe area at toe edge 428 of last 400 and then moves to rearward edge 420 of second area 416. At rearward edge 420 the braiding point reverses direction and moves along the direction of second arrow 419. The braiding point stops at forward edge 422 of second area 416. Therefore, the braiding point location and motion sets the boundaries of the various areas of braided component 404. For example, width 424 of second area 416 is defined as the distance between rearward edge 420 and forward edge 422. Rearward edge 420 may be placed further rearward if the braiding point continues along first arrow 418 for a greater distance. Likewise, forward edge 422 may be placed closer to toe edge 428 by moving the braiding point closer to toe edge 428 along second direction arrow 408. Therefore, the width of second area 416 may be determined by the location of the braiding point along last 400. Because the location of the braiding point may be determined by the relative location of last 400 within braiding machine 402, the motion of last 400 may determine the width of the various areas. Width 426 of first area 414 may be determined by the distance between toe edge 428 and forward edge 422 of second area 416. Therefore, width 426 may be determined by stopping the location of the braiding point along second direction arrow 408 as well as the length of the initial braid layer of braided component 404. Although first area 414 is depicted as beginning at toe edge 428, it should be recognized that the various areas may start and stop along the length of last 400. That is, in some embodiments, first area 414 may begin at a midfoot area as opposed to at toe edge 428.

Referring now to FIG. 34, the shape of first area 414 and second area 416 of braided component 404 is depicted at the instant shown in FIG. 32. As shown, first braided layer 410 and second braided layer 412 of braided component 404 are continuously formed. First area 414 is a single layer of braided component 404 that lies against the surface of last 400. Second braided layer 412 of second area 416 lies against first braided layer 410 of braided structure 404 and overlaps a portion of first braided layer 410. That is, second braided layer 412 overbraids a portion of first braided layer 410 such that second area 416 forms a multilayer region or portion of braided component 404. As shown, there is a crease or fold at rearward edge 420 of second area 416. This crease or first fold 423 is determined by the location of the braiding point at the time that the feeding direction of last 400 is reversed, which is also at the time that the location of the braiding point is reversed. Additionally, as depicted, second area 416 may extend around last 400 such that second area 416 is located along a lateral side and a medial side of last 400.

Figure 35:
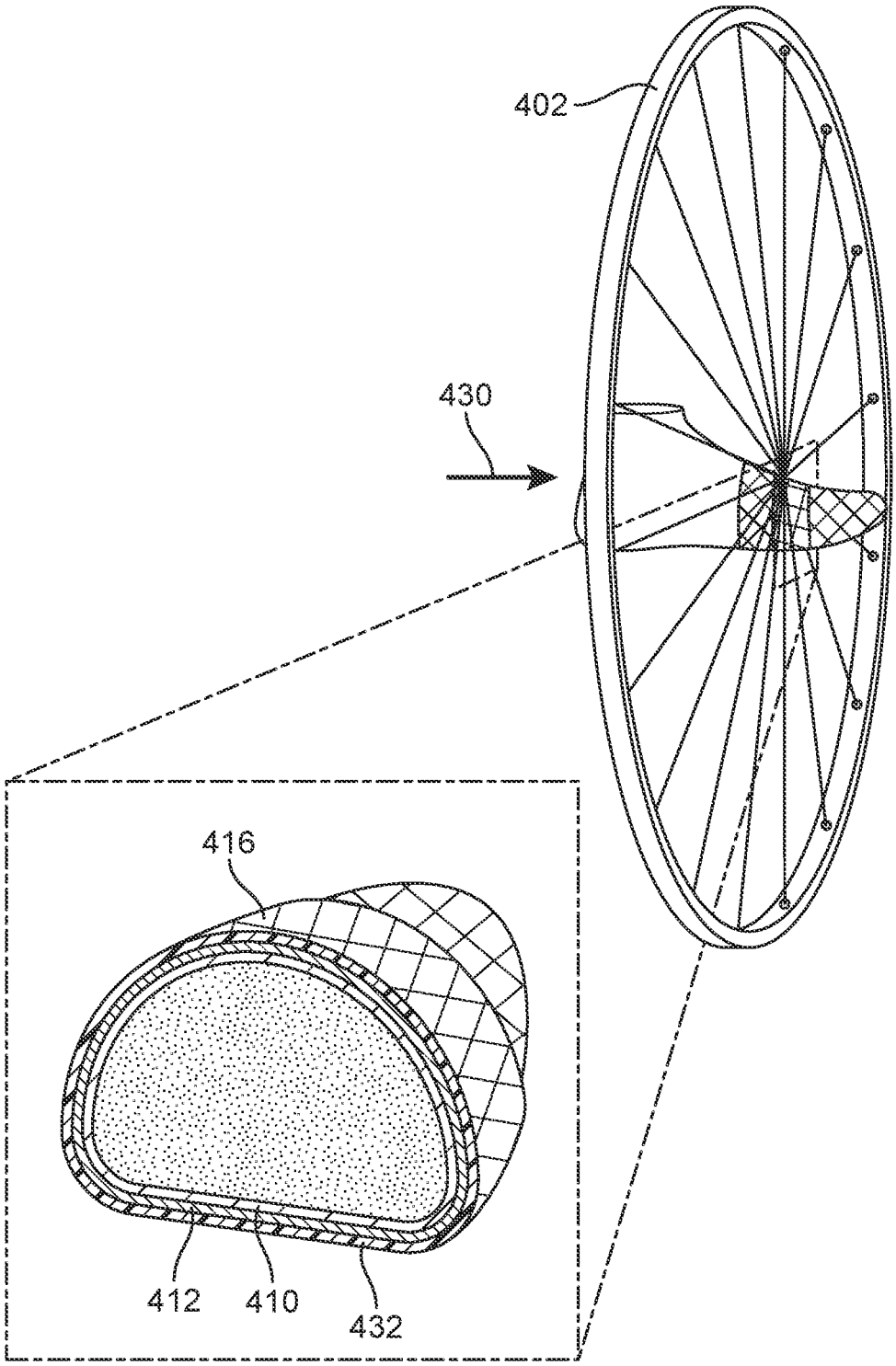
FIG. 35 is a schematic view of an embodiment of a last in a braiding machine.
Figure 36:
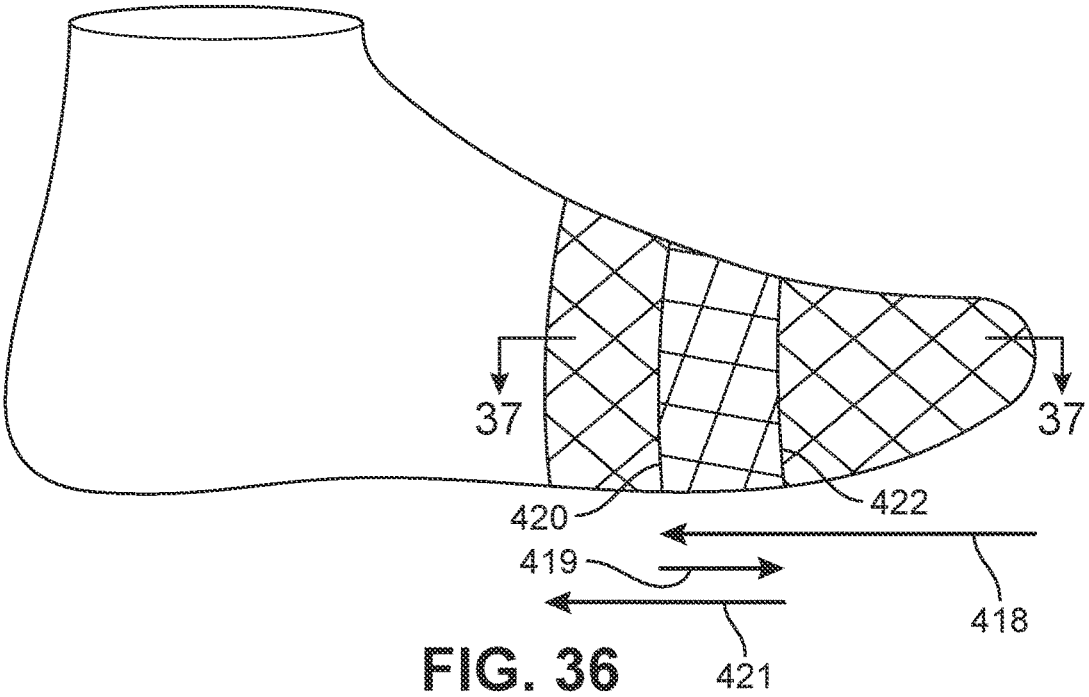
FIG. 36 is a schematic view of an embodiment of a braided component around a last.
Figure 37:
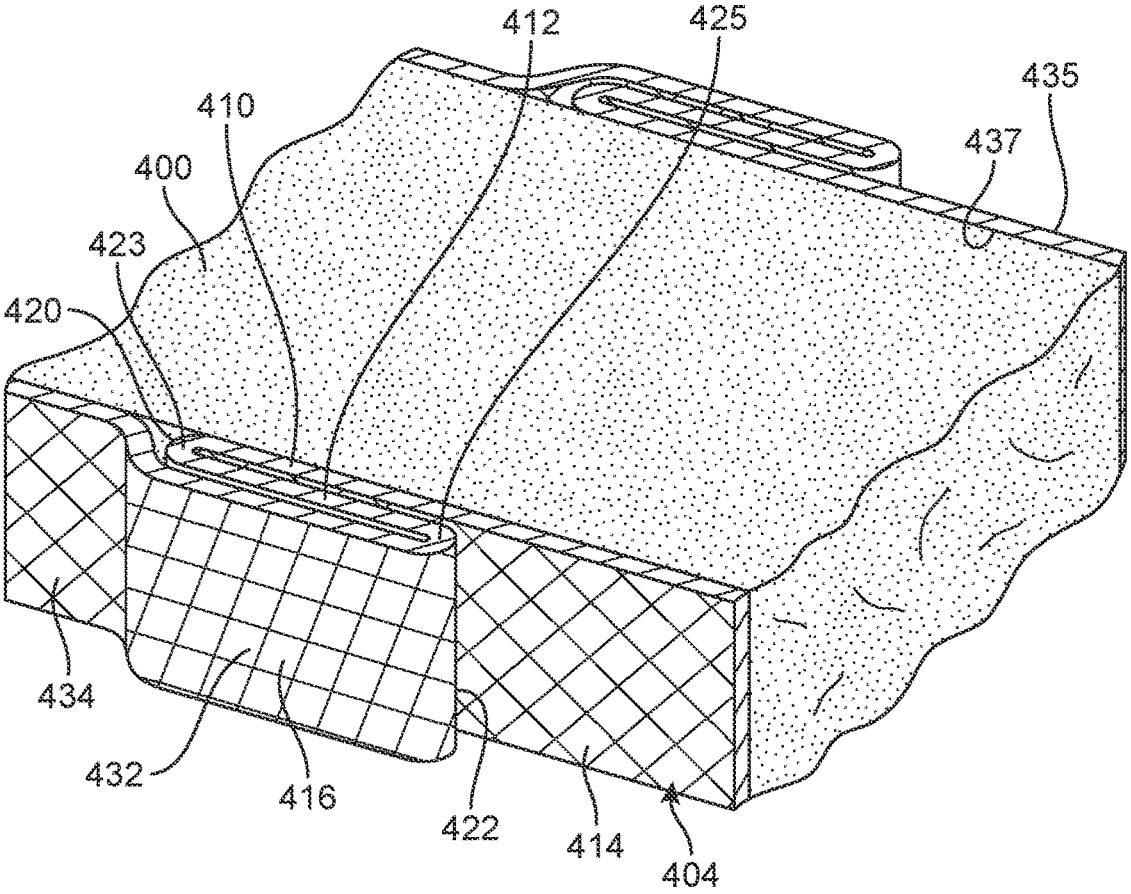
FIG. 37 is an isometric view of an embodiment of a portion of a braided component around a last.

Referring now to FIGS. 35-37, the feed direction of last 400 is now in a forward motion along the direction of third direction arrow 430. Third direction arrow 430 may be parallel to first direction arrow 406 as depicted in FIG. 30. This forward motion of last 400 causes an additional layer to be placed over a portion of last 400. As shown in the cross-sectional view of FIG. 35, there are now three layers located in second area 416. Therefore, second area 416 may be referred to as a multilayer region of braided component 404. First braided layer 410 is adjacent to last 400 as well as second braided layer 412. Second braided layer 412 is adjacent to first braided layer 410 as well as third braided layer 432. Third braided layer 432 overbraids second braided layer 412 such that third braided layer 432 overlaps second braided layer 412. Additionally, third braided layer 432 is located along an outer surface of braided component 404.

Referring to FIG. 36, the direction along which the braiding point travels and location is depicted. In this depiction, the braiding point moved along a direction parallel to third arrow 421. The braiding point moves from forward edge 422 and passes over rearward edge 420. Therefore, another layer is deposited over second braided layer 412 between forward edge 422 and rearward edge 420 in second area 416. This forms another crease or second fold 425 at the location of forward edge 422. As the braided structure extends past first fold 423 of rearward edge 420, a single layer of braided component 404 again contacts last 400. In this manner, a pleat may be formed along a portion of an article of footwear.

Referring particularly to FIG. 37, the shape of braided component 404 is shown depicting the shape of second area 416 and the location of portions of braided component 404 in relation to last 400. Braided component 404 is a continuous, uninterrupted layer of braided material. Braided component 404 is folded at various points such that three layers of braided material are stacked adjacent to each other and overlap each other. A single layer is shown in first area 414. Three layers of stacking braided material are depicted in second area 416. A single layer again is depicted in third area 434. Second braided layer 412 covers or overlaps a portion of first braided layer 410. Additionally, third braided layer 432 covers or overlaps second braided layer 412. By increasing the material density of braided component 404, the pleat or folded area of braided component 404 may increase the strength of the article in second area 416. A pleat such as second area 416 may be formed at various locations throughout a braided component for various purposes. For example, a pleat may increase the strength at a particular area in a braided component. In other embodiments, a pleat may be used for aesthetic purposes.

Braided component 404 may be folded such that various surfaces of braided component 404 touch each other. For example, outer surface 435 of braided component 404 may fold such that outer surface 435 abuts itself. Further, braided component 404 may also be folded such that inner surface 437 also abuts itself. At first fold 423, outer surface 435 reverses direction such that outer surface 435 in the area of second braided layer 412 faces toward last 400. Additionally, in this area, outer surface 435 may abut against itself. Likewise, inner surface 437 may abut itself between second braided layer 412 and third braided layer 432. In the area of second braided layer 412, inner surface 437 is facing away from last 400 and abuts inner surface 437 of third braided layer 432. In this manner, portions of braided component 404 may be covered by braided component 404 itself.

After completion of the braiding process, the braided component may be heated to secure the layers in place. For example, in some embodiments, the material used to form braided component 404 may include thermoplastic materials. Heating braided component 404 may cause portions of braided component 404 to melt and solidify in place. In other embodiments, the pleat may be depicted as second area 416 may be secured using heat. In further embodiments, the pleat may be secured by glue or another adhesive. In still further embodiments, the pleat of second area 416 may be secured by stitching or other mechanism. As such, the pleat of second area 416 may be secured in place so that the layers of second area 416 remain locked in place. That is, the layers of second area 416 may be restricted from moving laterally with respect to each other. Last 400 may then be removed and additional post processing may be performed on braided component 404 to form an article of footwear that incorporated braided component 404.

Figure 38:
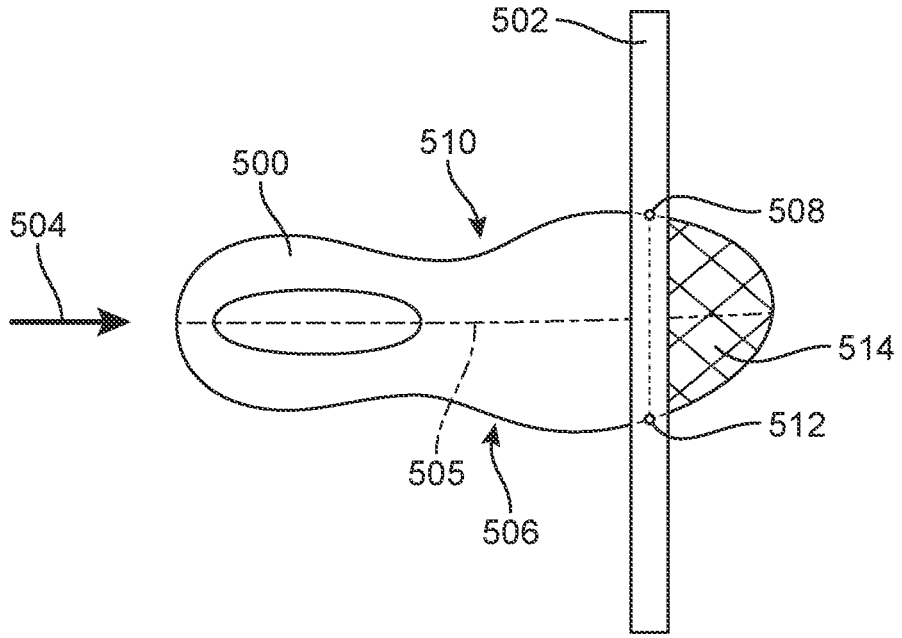
FIG. 38 is a top view of an embodiment of a last in a braiding machine.

Referring now to FIGS. 38-42, a pleat is formed over a last. A top view of last 500 is shown passing through braiding machine 502 at various orientations. The pleat may be formed in substantially the same manner as the pleat formed in second area 416 as depicted in FIGS. 29-37. As shown in FIG. 38, last 500 is passed through the braiding point of braiding machine 502. Last 500 is moved along a forward direction parallel to first direction arrow 504. In the configuration as shown in FIG. 38, last 500 is substantially congruent or perpendicular to braiding machine 502. That is, line 505 that passes from a heel edge to a toe edge of last 500 is substantially perpendicular to braiding machine 502 when viewed from a top view. In this view, medial point 508 of medial side 510 and first lateral point 512 of lateral side 506 are both located at about the braiding point of braiding machine 502. Medial point 508 and first lateral point 512 may not be visible on braided component 514, but are included for purposes of illustration to assist in identifying the motion of last 500 during the braiding process. As depicted in FIG. 38, a single layer of braided component 514 is applied to last 500. Additionally, the single layer is located between the toe edge of last 500 and medial point 508 and first lateral point 512.

Figure 39:
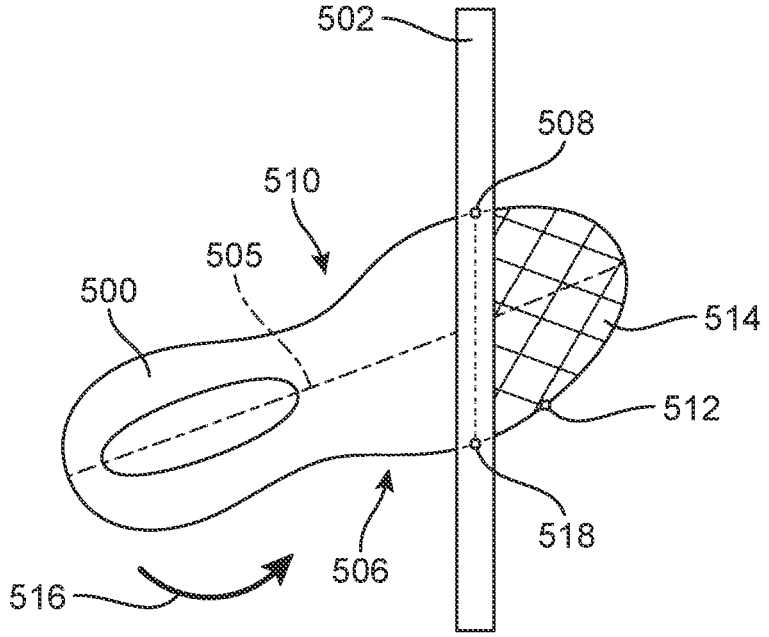
FIG. 39 is a top view of an embodiment of a last at an angle in a braiding machine.

Referring to FIG. 39, last 500 has been tilted or twisted along a direction shown by second direction arrow 516 such that line 505 is no longer perpendicular with braiding machine 502. As shown, last 500 twists about medial point 508 of last 500 such that medial point 508 acts as a virtual pivot point for last 500. In this manner, medial point 508 of last 500 does not move to the same extent as first lateral point 512 of lateral side 506. First lateral point 512 of lateral side 506 passes through the braiding point of braiding machine 502 such that additional material is added on to braided component 514 between first lateral point 512 and second lateral point 518. Second lateral point 518 is now located within the braiding point of braiding machine 502. Therefore, braided component 514 is deposited along second lateral point 518. Additionally, second lateral point 518 may determine the rearward edge of a pleat. The amount of material added to braided component 514 may be determined by the degree to which last 500 is tilted or translated during manufacturing. Additionally, last 500 may be tilted or twisted to various degrees during manufacturing, and the embodiment depicted is merely one example of the opportunities for pleat manufacturing using a braiding machine.

Figure 40:
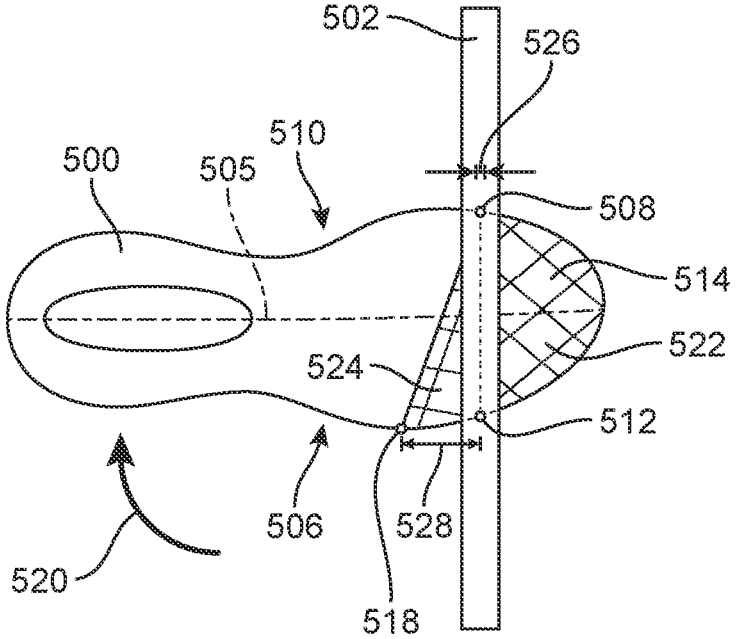
FIG. 40 is a top view of an embodiment of a last in a braiding machine.

Referring now to FIG. 40, last 500 is rotated back along the path of third direction arrow 520 such that line 505 is substantially perpendicular to braiding machine 502. First lateral point 512 is now located within the braiding point of braiding machine 502 while second lateral point 518 is located on an opposite side of braiding machine 502 from the toe edge of last 500. In this manner, first area 522 and second area 524 are formed. First area 522 may be a single layer of braided component 514 while second area 524 may include two layers of braided component 514. At this instant, second area 524 may be similar in construction to second area 416 as depicted in FIG. 34. In the embodiment as shown, however, a greater portion of lateral side 506 may be covered by braided component 514 than medial side 510 of last 500. As shown in FIG. 34, a substantially similar proportion of last 400 is overbraided by braided component 404.

As depicted, second area 524 may have a variable width. For example, medial width 526 may be less than lateral width 528 of second area 524. The variations of width of second area 524 may be determined by the degree of twist to which last 500 is subjected. Increasing the degree of twist while keeping medial point 508 in the same place will increase the lateral width 528 of second area 524. Likewise, reducing the degree of twist while keeping medial point 508 in the same place will decrease lateral width 528 of second area 524. Additionally, medial width 526 may be varied by varying the degree of twist or longitudinal movement of last 500 along medial side 510. For example, medial point 508 may be permitted to rotate or move longitudinally through the braiding point of braiding machine 502 in a similar manner to first lateral point 512. Therefore, the rotation and movement of last 500 may be varied by a user or machine to form a particularly sized medial width 526 and lateral width 528 of second area 524. In some embodiments, lateral width 528 may be up to 10 percent larger than medial width 526. In other embodiments, lateral width 528 may be up to 50 percent larger than medial width 526. In still further embodiments, lateral width 528 may be up to 100 percent larger or more than 100 percent larger than medial width 526.

Figure 41:
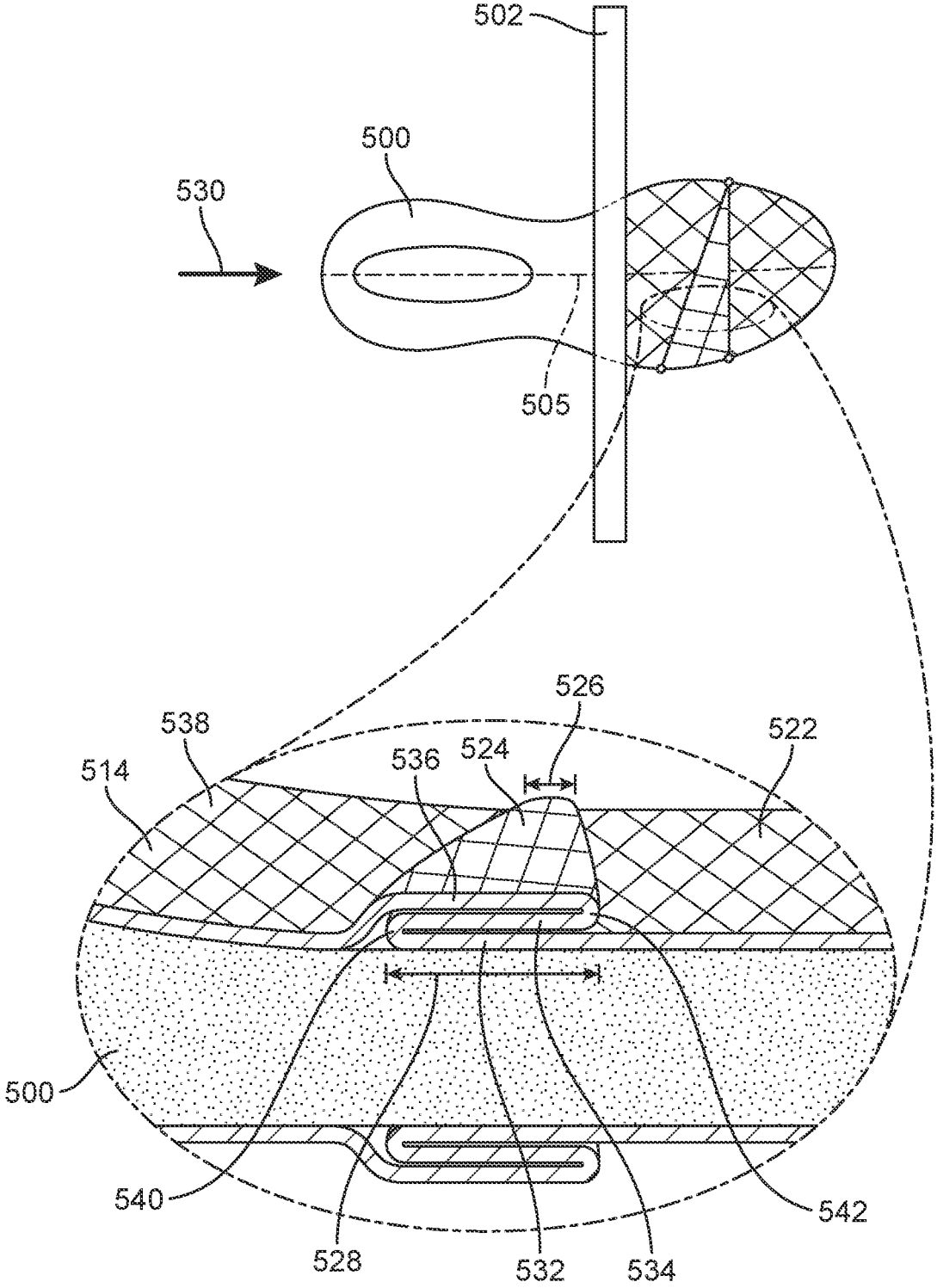
FIG. 41 is a schematic view of an embodiment of a pleat formed by a braiding machine.

Finally, in FIG. 41, last 500 is moved along a direction depicted by fourth direction arrow 530 through braiding machine 502. As last 500 is moved through the braiding point, a third layer is deposited along second area 524. This forms a similar braided structure to the structure depicted in FIG. 37. As shown in FIG. 41, first braided layer 532 is located adjacent to the surface of last 500. Second braided layer 534 is located adjacent to first braided layer 532 as well as third braided layer 536. Third braided layer 536 is adjacent to second braided layer 534 and may be located along an outer surface of an upper that incorporates braided component 514. Further, as shown, first area 522 is composed of a single layer. Second area 524 is composed of three layers, and third area 538 is composed of a single layer. Each of the areas is uniformly formed in a continuous and uninterrupted manner. That is, the strands from each of the areas continuously flow through each of the areas. Further, each of the layers is also uniformly and continuously formed through the braiding process.

Referring particularly to the cross section depicted in FIG. 41, the structure of second area 524 is depicted. First braided layer 532 passes along the outer surface of last 500. At first fold 540, braided component 514 changes direction and location. From first fold 540 second braided layer 534 extends along an upper surface of first braided layer 532 in a continuous manner. Second braided layer 534 extends toward the toe edge of last 500 to second fold 542. At second fold 542, the direction of braided component 514 reverses and extends back toward the rear edge of last 500, thereby forming third braided layer 536. The multiple layers of second area 524 may be utilized to form a resilient area of an article that incorporates a pleat such as second area 524.

As shown, braided component 514 includes a variable width pleated portion. The pleated portion may be formed by rotating and twisting last 500 at particular points. For example, last 500 as depicted in FIGS. 38-41 is moved or rotated in a yaw direction as depicted in FIGS. 39 and 40. In other embodiments, pleats of different shapes may be formed during manufacturing. By changing the yaw angle or direction, a pleat formed over last 500 may have different widths along a medial side as compared to a lateral side. In other embodiments, the pitch of last 500 may be changed or altered during manufacturing. In such embodiments, a pleat formed on last 500 may have a different width along a lower surface of last 500 as compared to the upper surface of last 500. By pitching last 500, variously shaped pleats may be formed.

Figure 42:
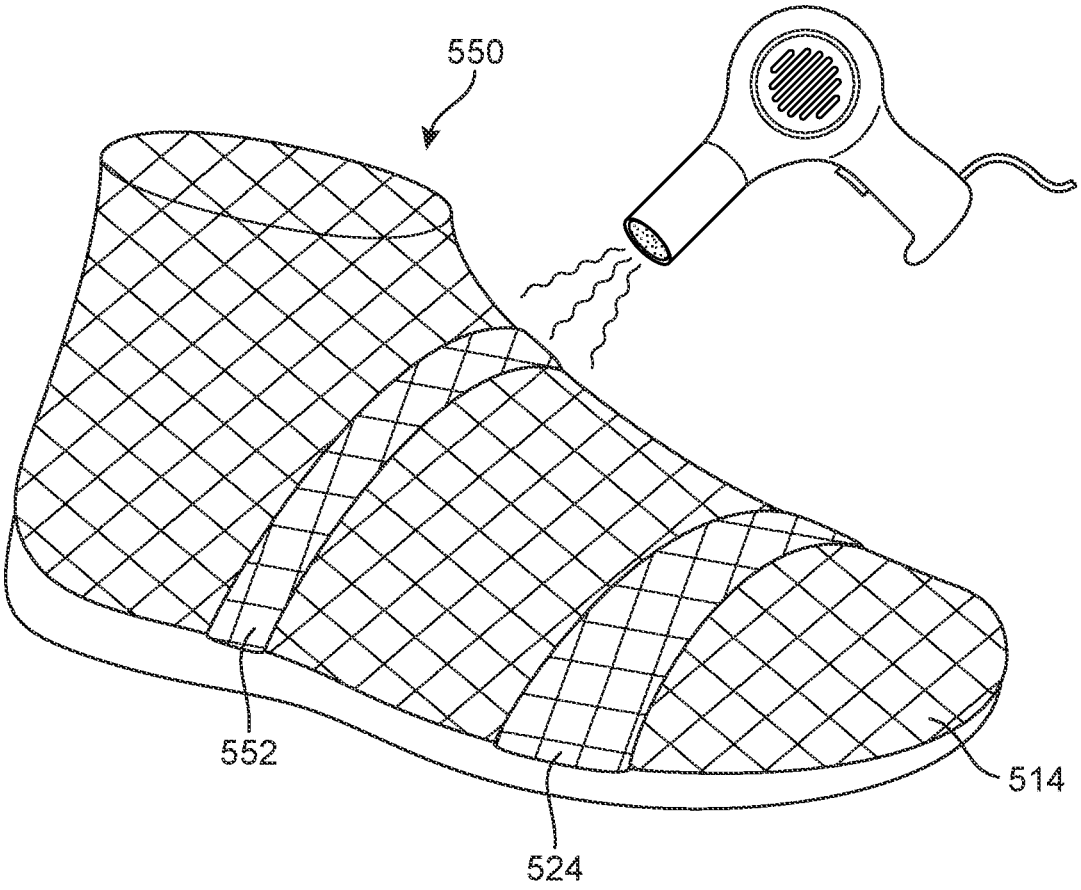
FIG. 42 is a schematic view of an article of footwear that incorporates a braided pleat.

Referring to FIG. 42, article of footwear 550, or simply article 550, is depicted and includes braided component 514. Further, article 550 includes a pleat formed at second area 524. In addition to second area 524, fourth area 552 is formed. In some embodiments, fourth area 552 may be a pleat formed in a substantially similar manner to the manufacturing process previously discussed. As depicted, multiple pleats may be formed along an article. The pleats may be particularly shaped and placed to counteract forces that may act upon article 550. Article 550 may be subjected to heat to lock in or solidify portions of article 550. As discussed previously, braided component 514 may include thermoplastic materials, including pleated portions that are subjected to heat. Heat may activate thermoplastic materials or adhesion materials that are located in braided component 514. In some embodiments, the heat may be particularly directed along pleats in order to secure the pleats in a particular location. This allows article 550 to have particular areas that are formed to resist stretch and provide support while other areas may be breathable.

Although shown in the shape of an athletic shoe, it should be recognized that variously shaped lasts in addition to other objects may be used in the process. For example, in some embodiments a boot-shape last may be utilized while in other embodiments a sandal-shaped last may be utilized. In other embodiments, a baseball bat shaped article or glove may be utilized. In still further embodiments, other articles or objects may be utilized.

While various embodiments have been described, the description is intended to be exemplary, rather than limiting, and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

The invention claimed is:

1. A method of making an article of footwear, comprising:
attaching a plate to the bottom of a first layer, the first layer being disposed on a last;
wherein the plate has at least one aperture;
inserting a deflector into the at least one aperture;
passing the last with the first layer, the plate and the deflector through a braiding
machine and forming a second layer around the first layer and the plate;
wherein the second layer is a braided layer and wherein the deflector extends through the second layer.

2. The method according to claim 1, wherein the method includes removing the deflector from the aperture in the plate after the second layer has been formed around the first layer.

3. The method according to claim 1, wherein the method includes inserting a cleat into the aperture after the deflector has been removed from the aperture.

4. The method according to claim 3, wherein at least a portion of the second layer is disposed between the cleat and the plate.

5. The method according to claim 1, wherein the deflector has a peg-like geometry with a rounded end.

6. The method according to claim 1, wherein the deflector changes a direction of one or more strands of the second layer as the second layer is being formed around the first layer and the plate.

7. The method according to claim 1, wherein the plate includes a plurality of apertures; and the method further comprising inserting a deflector into each aperture of the of apertures in the plate prior to forming the second layer around the first layer and the plate.

8. The method according to claim 7, wherein the deflectors inserted into each aperture of the plurality of apertures prevents the second layer from being overbraided on top of the plurality of apertures in the plate.

9. The method according to claim 8, further comprising:

removing the deflectors from each aperture of the plurality of apertures after forming the second layer; and inserting a cleat into each aperture of the plurality of apertures in the plate.

10. The method according to claim 1, wherein the first layer and the second layer are bonded to each other.

11. An article of footwear comprising:

a braided upper including a first braided layer;

a plate including a plurality of apertures, wherein the plate is attached to the first braided layer of the braided upper;

a second braided layer overbraided on top of the first braided layer and the plate; and a plurality of ground engaging members, wherein each ground engaging member of the plurality of ground engaging members is inserted into a corresponding aperture of the plurality of apertures in the plate.

12. The article of footwear according to claim 11, wherein a portion of each ground engaging member contacts the second braided layer when inserted into the corresponding aperture in the plate.

13. The article of footwear according to claim 11, wherein each ground engaging member passes through the second braided layer when inserted into the corresponding aperture in the plate.

14. The article of footwear according to claim 11, wherein the second braided layer covers the plurality of apertures in the plate.

15. The article of footwear according to claim 11, wherein the second braided layer does not cover the plurality of apertures in the plate.

16. The article of footwear according to claim 11, wherein one or more strands of the second braided layer change direction around the plurality of apertures in the plate so that the plurality of apertures are clear from the one or more strands of the second braided layer.

17. The article of footwear according to claim 11, wherein an area of the second braided layer that is adjacent to each aperture of the plurality of apertures has a density of strands that is greater than a density of strands of an area that is spaced from each aperture of the plurality of apertures.

18. An article of footwear comprising:

a braided upper including a first braided layer;

a plate including a plurality of apertures, wherein the plate is attached to the first braided layer of the braided upper; and a second braided layer overbraided on top of the first braided layer and the plate;

wherein the first braided layer contacts an upper surface of the plate; and wherein the second braided layer contacts a lower surface of the plate opposite the upper surface.

19. The article of footwear according to claim 18, wherein the second braided layer further contacts side surfaces of the plate.

20. An article of footwear including a heel region and a forefoot region, the article of footwear comprising:

a braided upper including a first braided layer;

a plate including a plurality of apertures, wherein the plate is attached to the first braided layer of the braided upper, and wherein the plate is arranged in a footbed and extends from the heel region to the forefoot region of the article of footwear;

a second braided layer overbraided on top of the first braided layer and the plate; and a plurality of ground engaging members, wherein each ground engaging member of the plurality of ground engaging members is inserted into a corresponding aperture of the plurality of apertures in the plate.

21. An article of footwear including a heel region and a forefoot region, the article of footwear comprising:

a braided upper including a first braided layer;

a plate including a plurality of apertures, wherein the plate is attached to the first braided layer of the braided upper, and wherein the plate is arranged in a footbed and extends from the heel region to the forefoot region of the article of footwear, wherein the first braided layer contacts an upper surface of the plate and the second braided layer contacts a lower surface of the plate opposite the upper surface; and a second braided layer overbraided on top of the first braided layer and the plate, wherein the second braided layer further contacts side surfaces of the plate.

* * * * *